US011884313B2

(12) United States Patent
Kitajima et al.

(10) Patent No.: US 11,884,313 B2
(45) Date of Patent: Jan. 30, 2024

(54) RAILROAD EQUIPMENT STATE DETERMINATION APPARATUS AND RAILROAD EQUIPMENT STATE DETERMINATION METHOD

(71) Applicant: KYOSAN ELECTRIC MFG. CO., LTD., Yokohama (JP)

(72) Inventors: Toshio Kitajima, Yokohama (JP); Youichi Murakami, Yokohama (JP)

(73) Assignee: KYOSAN ELECTRIC MFG. CO., LTD., Yokohama (JP)

( * ) Notice: Subject to any disclaimer, the term of this patent is extended or adjusted under 35 U.S.C. 154(b) by 792 days.

(21) Appl. No.: 16/996,072

(22) Filed: Aug. 18, 2020

(65) Prior Publication Data

US 2020/0377132 A1 Dec. 3, 2020

Related U.S. Application Data

(63) Continuation of application No. PCT/JP2019/006544, filed on Feb. 21, 2019.

(30) Foreign Application Priority Data

Feb. 26, 2018 (JP) ..... 2018-032109

(51) Int. Cl.
*B61L 5/10* (2006.01)
*B61L 5/06* (2006.01)
(Continued)

(52) U.S. Cl.
CPC ..... *B61L 5/102* (2013.01); *B61L 5/06* (2013.01); *B61L 23/04* (2013.01); *E01B 7/20* (2013.01)

(58) Field of Classification Search
CPC .. B61L 5/06; B61L 5/102; B61L 5/107; B61L 23/04; B61L 27/16; B61L 27/53; E01B 7/20
(Continued)

(56) References Cited

U.S. PATENT DOCUMENTS 6,427,950 B1 * 8/2002 Hoyer ..... B61L 5/107 246/260
6,484,974 B1 * 11/2002 Franke ..... B61L 5/107 246/220
(Continued)

FOREIGN PATENT DOCUMENTS

CN 101893667 A 11/2010
JP 3008097 U 3/1995
(Continued)

OTHER PUBLICATIONS

English translation of International Search Report for PCT/JP2019/006544 dated May 14, 2019.
(Continued)

*Primary Examiner* — Christopher P Schwartz
(74) *Attorney, Agent, or Firm* — Muncy, Geissler, Olds & Lowe, P.C.

(57) ABSTRACT

A railroad equipment state determination apparatus includes: a storage that stores a plurality of operation data associated with a prescribed operation performed by railroad equipment that is driven by a motor from a stopped state to perform the prescribed operation and then comes into the stopped state again; an evaluation criteria setting section that sets evaluation criteria based on the plurality of operation data stored in the storage; and a determination section that determines whether new operation data resulting from the prescribed operation newly performed by the railroad equipment is abnormal based on the evaluation criteria.

12 Claims, 15 Drawing Sheets

(51) Int. Cl.
*B61L 23/04* (2006.01)
*E01B 7/20* (2006.01)

(58) Field of Classification Search
USPC ..... 246/218–225, 260
See application file for complete search history.

(56) References Cited

U.S. PATENT DOCUMENTS

| | | | | |
|---|---|---|---|---|
| 9,284,692 | B2 * | 3/2016 | Duan | B61L 27/16 |
| 10,710,617 | B2 * | 7/2020 | Nagrodsky | B61L 23/04 |
| 2015/0158511 | A1 * | 6/2015 | Fries | B61L 27/53 324/511 |
| 2019/0054939 | A1 | 2/2019 | Kono et al. | |

FOREIGN PATENT DOCUMENTS

| | | | |
|---|---|---|---|
| JP | 2002-209303 | A | 7/2002 |
| JP | 2005-186822 | A | 7/2005 |
| JP | 2009-083577 | A | 4/2009 |
| JP | 2016-084076 | A | 5/2016 |
| JP | 2019-022306 | A | 2/2019 |
| WO | 2017/145665 | A1 | 8/2017 |
| WO | 2019/012730 | A1 | 1/2019 |

OTHER PUBLICATIONS

The extended European search report of the corresponding EP application No. 19757858.6 dated Oct. 28, 2021.

* cited by examiner

RAILROAD EQUIPMENT STATE DETERMINATION APPARATUS AND RAILROAD EQUIPMENT STATE DETERMINATION METHOD

CROSS REFERENCE TO RELATED APPLICATION

This application is a continuation of International Patent Application No. PCT/JP2019/006544, having an international filing date of Feb. 21, 2019, which designated the United States, the entirety of which is incorporated herein by reference. Japanese Patent Application No. 2018-032109 filed on Feb. 26, 2018 is also incorporated herein by reference in its entirety.

BACKGROUND

There have been developed various methods for monitoring switching operations of an electric switch machine as one piece of railroad equipment. For example, Japanese Unexamined Patent Application Publication No. 2009-083577 describes that acquiring a number of pulses proportional to the number of rotations of a servo motor from an encoder accompanying the motor and measuring the load on the motor makes it possible to obtain a graph indicating the torque (switching torque) of the motor relative to a series of steps of switching operation (switching stroke). Japanese Unexamined Patent Application Publication No. 2009-083577 also describes a technique for determining whether an abnormality has occurred in one cycle of switching operation from the torque (switching torque) of the motor to the switching operation (switching stroke).

However, switch machines have individual characteristics of switching operation load and differ from one another in switching torque data depending on the installation position, turnout type, turnout number, state of tongue rails, shape of tongue rails, and the like. Thus, maintenance technicians (users) need to perform final checking of the operation status of the switch machines on their own experience and expertise. Accordingly, they have to check the operation status of individual switch machines one by one, rather than collectively checking the operation status of a plurality of switch machines in accordance with uniform criteria. This takes an immense amount of time and effort to perform checking.

This problem is not limited to switch machines but is also applicable to monitoring of the operation status of other railroad equipment such as railroad crossing gates with a crossing rod moving up and down and platform doors with a door part opening and closing.

DESCRIPTION OF EXEMPLARY EMBODIMENTS

Figure 1:
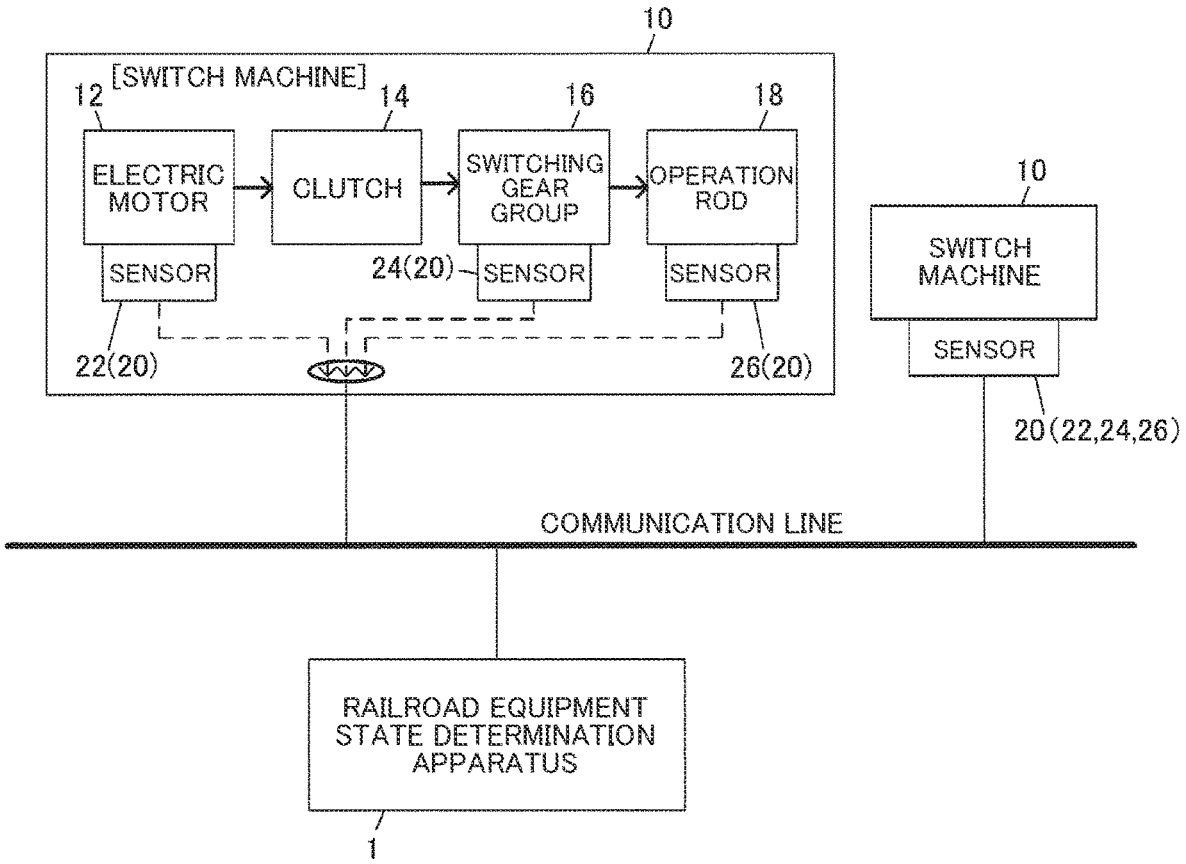
FIG. 1 is a diagram illustrating an application example of a railroad equipment state determination apparatus.

The following disclosure provides many different embodiments, or examples, for implementing different features of the provided subject matter. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. Further, when a first element is described as being "connected" or "coupled" to a second element, such description includes embodiments in which the first and second elements are directly connected or coupled to each other, and also includes embodiments in which the first and second elements are indirectly connected or coupled to each other with one or more other intervening elements in between.

A first aspect is the railroad equipment state determination apparatus comprising:

a storage that stores a plurality of operation data associated with a prescribed operation performed by railroad equipment that is driven by a motor from a stopped state to perform the prescribed operation and then comes into the stopped state again;

an evaluation criteria setting section that sets evaluation criteria based on the plurality of operation data stored in the storage; and a determination section that determines whether new operation data resulting from the prescribed operation newly performed by the railroad equipment is abnormal based on the evaluation criteria.

As a result, in the first aspect of the disclosure, it is possible to store the plurality of operation data associated with the prescribed operation of the railroad equipment driven by the motor and set the evaluation criterion using the plurality of operation data. Then, based on the set evaluation criterion, it is possible to determine whether the new operation data resulting from the prescribed operation newly performed by the railroad equipment is abnormal. This realizes the new technique for setting the evaluation criterion for the individual pieces of railroad equipment and determining whether the prescribed operation of the railroad equipment is abnormal based on the evaluation criterion corresponding to the railroad equipment.

A second aspect is the railroad equipment state determination apparatus in the first aspect, in which the storage stores the operation data in association with operation dates, and the evaluation criteria setting section sets the evaluation criteria based on the operation data for a predetermined number of days nearest the operation date of the new operation data.

As a result, in the second aspect of the disclosure, it is possible to determine whether the new operation data is abnormal by the use of the evaluation criterion set from the operation data for the predetermined number of nearest dates.

A third aspect is the railroad equipment state determination apparatus in the first or second aspect, in which the operation data includes data of operation time of the prescribed operation, the evaluation criteria setting section sets an operation time threshold condition for determining that the operation time is abnormal as one of the evaluation criteria, based on distribution of the operation times included in the operation data, and the determination section determines whether the operation time included in the new operation data is abnormal based on the operation time threshold condition.

In the event of any abnormality in the target railroad equipment, its operation time tends to be longer. As a result, in the third aspect of the disclosure, it is possible to set the operation time threshold condition based on distribution of the operation times from the past operation data. Then, it is possible to determine whether the operation time of the new operation data is abnormal based on the set operation time threshold condition.

A fourth aspect is the railroad equipment state determination apparatus in any of the first to third aspect, in which the operation data includes data of operation time of the prescribed operation, the determination section performs:

calculating an operation time abnormality relating to the new operation data, based on the operation time included in the new operation data and the distribution of the operation times included in a predetermined number of the operation data before the prescribed operation associated with the new operation data; and determining whether the new operation data is abnormal based on whether the operation time abnormality satisfies a given operation time abnormality threshold condition, and the evaluation criteria setting section sets the operation time abnormality threshold condition as one of the evaluation criteria, based on the operation time abnormalities calculated in the past.

As a result, in the fourth aspect of the disclosure, it is possible to calculate the operation time abnormality relating to the new operation data based on the operation time of the new operation data and the distribution of the operation times of the operation data associated with the earlier prescribed operations. It is also possible to set the operation time abnormality threshold condition based on the operation time abnormality relating to the past operation data. Then, it is possible to determine whether the new operation data is abnormal depending on whether the calculated operation time abnormality satisfies the operation time abnormality threshold condition. As a result, in some embodiments, the operation time abnormality threshold condition is set from the past operation data of the railroad equipment, which saves the user from having to set the condition.

Further, a fifth aspect is the railroad equipment state determination apparatus in the first or second aspect, in which the operation data includes data of quantity of electricity required for the prescribed operation, the evaluation criteria setting section sets an quantity of electricity threshold condition for determining that the quantity of electricity is abnormal as one of the evaluation criteria, based on distribution of quantity of electricity included in the operation data, and the determination section determines whether the quantity of electricity included in the new operation data is abnormal based on the quantity of electricity threshold condition.

In the event of any abnormality in the target railroad equipment, the operation time tends to be longer and the quantity of electricity also shows an increasing tendency. As a result, in the fifth aspect of the disclosure, it is possible to set the quantity of electricity threshold condition based on the distribution of the quantity of electricity in the past operation data. Then, it is possible to determine whether the quantity of electricity in the new operation data is abnormal based on the set quantity of electricity threshold condition.

A sixth aspect is the railroad equipment state determination apparatus in the first second, or fifth aspect, in which the operation data includes data of the quantity of electricity required for the prescribed operation, the determination section performs:

calculating an quantity of electricity abnormality relating to the new operation data, based on the quantity of electricity included in the new operation data and distribution of the quantity of electricity included in a predetermined number of the operation data before the prescribed operation associated with the new operation data; and determining whether the new operation data is abnormal based on whether the quantity of electricity abnormality satisfies a given quantity of electricity abnormality threshold condition, and the evaluation criteria setting section sets the quantity of electricity abnormality threshold condition as one of the evaluation criteria, based on the quantity of electricity abnormalities calculated in the past.

As a result, in the sixth aspect of the disclosure, it is possible to calculate the quantity of electricity abnormality relating to the new operation data based on the quantity of electricity of the new operation data and the distribution of quantity of electricity of operation data associated with the earlier prescribed operations. It is also possible to set the quantity of electricity abnormality threshold condition based on the quantity of electricity abnormality relating to the past operation data. Then, it is possible to determine whether the new operation data is abnormal depending on whether the calculated quantity of electricity abnormality satisfies the quantity of electricity abnormality threshold condition. As a result, in some embodiments, the quantity of electricity abnormality threshold condition is set from the past operation data of the railroad equipment, which saves the user from having to set the condition.

A seventh aspect is the railroad equipment state determination apparatus in any of the first to sixth aspect, in which the operation data includes data of drive transition information indicating drive information of the motor at each timing during the prescribed operation, the evaluation criteria setting section sets statistic transition information that indicates transition of statistics determined by statistically computing the drive information at each timing during the prescribed operation as one of the evaluation criteria, based on the drive transition information included in the operation data, and the determination section performs:

calculating transition of a degree of abnormality relating to the new operation data by comparing the drive transition information included in the new operation data with the statistic transition information at each timing during the prescribed operation;

calculating a total degree of abnormality by synthesizing the transition of the degree of abnormality; and determining whether the new operation data is abnormal based on the total degree of abnormality.

As a result, in the seventh aspect of the disclosure, the drive information of the motor at each timing during the prescribed operation is included as the drive transition information in the operation data, while the drive transition information of the plurality of stored operation data is statistically computed at each timing. This makes it possible to set the statistic transition information indicating the transition of the statistics at each timing as the evaluation criterion. Then, the drive transition information of the new operation data and the statistic transition information are compared at each timing during the prescribed operation to calculate the degree of abnormality relating to the new operation data, and then the calculated degrees of abnormality are integrated to calculate the total degree of abnormality. Thus, it is possible to determine whether the new operation data is abnormal based on the total degree of abnormality. As a result, in some embodiments, it is possible to evaluate the entire prescribed operation of the target railroad equipment and calculate the total degree of abnormality that is one parameter. Therefore, it is possible to determine whether the prescribed operation of the railroad equipment is abnormal based on the total degree of abnormality, whatever abnormality occurs such as an error that is minor but is found in the entire prescribed operation or an instantaneous increase of value.

An eighth aspect is the railroad equipment state determination apparatus in the seventh aspect, further comprising a total abnormality storage that stores the total degrees of abnormality calculated in the past, wherein the evaluation criteria setting section sets a total abnormality threshold condition for determining that the new operation data is abnormal as one of the evaluation criteria, based on the total degrees of abnormality stored in the total abnormality storage, and the determination section determines whether the new operation data is abnormal based on whether the total degree of abnormality of the new operation data satisfies the total abnormality threshold condition.

As a result, in the eighth aspect of the disclosure, it is possible to set the total abnormality threshold condition based on the total degrees of abnormality in the past operation data. Then, it is possible to determine whether the new operation data is abnormal depending on whether the total abnormality threshold condition is satisfied. As a result, in some embodiments, the total abnormality threshold condition is set from the past operation data of the railroad equipment, which saves the user from having to set the condition.

A ninth aspect is the railroad equipment state determination apparatus in any of the seventh or eighth aspect, in which the prescribed operation includes a displacement operation of displacing a moving part by the railroad equipment, and the drive transition information is information that indicates transition of the drive information with a displacement position of the moving part at each timing during the prescribed operation.

In the ninth aspect of the disclosure, the displacement operation of the railroad equipment displacing the moving part is set as the prescribed operation, and the transition of the drive information at each displacement position of the moving part during the displacement operation is set as the drive transition information. For example, in the switch machine as one piece of the railroad equipment, an operation rod as the moving part is displaced within a constant range at one displacement operation. As a result, in the ninth aspect of the disclosure, it is possible to set the statistic transition information by statistically computing each drive transition information that is included in the plurality of past operation data, at each displacement position from the start to end of the prescribed operation. It is also possible to compare the drive transition information of the new operation data with the statistic transition information at each displacement position from the start to end of the prescribed operation.

A tenth aspect is the railroad equipment state determination apparatus as defined in the seventh or eighth aspect, in which the prescribed operation includes a displacement operation of displacing a moving part by the railroad equipment, and the drive transition information is information that indicates transition of the drive information with a lapse of time from start to end of displacement of the moving part at each timing.

In the tenth aspect of the disclosure, the displacement operation of the railroad equipment displacing the moving part is set as the prescribed operation, and the transition of the drive information involved in the lapse of time from the start to end of the displacement of the moving part is set as the drive transition information. As a result, in some embodiments, it is possible to set the statistic transition information by statistically computing each drive transition information that is included in the plurality of past operation data at each lapse of time from the start to end of the displacement of the moving part. It is also possible to compare the drive transition information of the new operation data with the statistic transition information at each lapse of time from the start to end of the displacement.

An eleventh aspect is the railroad equipment state determination apparatus in any of the seventh to tenth aspect, in which the drive information is information of torque or current.

As a result, in the eleventh aspect of the disclosure, it is possible to determine whether the operation data in which the drive information of the motor is torque or current information is abnormal.

A twelfth aspect is the railroad equipment state determination apparatus in any of the first to eleventh aspect, in which the railroad equipment is any of switch machine, railroad crossing gate, and platform door.

As a result, in the twelfth aspect of the disclosure, it is possible to determine whether the operation data of any of the switch machine, railroad crossing gate, and platform door that are the railroad equipment is abnormal.

Further, a thirteenth aspect is a railroad equipment state determination method comprising:

an evaluation criteria setting step of setting evaluation criteria based on data that is an accumulation of operation data associated with a prescribed operation performed by railroad equipment that is driven by a motor from a stopped state to perform the prescribed operation and then comes into the stopped state again; and a determination step of determining whether new operation data resulting from the prescribed operation newly performed by the railroad equipment is abnormal based on the evaluation criteria.

As a result, in the thirteenth aspect of the disclosure, it is possible to implement the railroad equipment state determination method that produces the same advantageous effects as those of the first aspect of the disclosure.

Exemplary embodiments are described below. Note that the following exemplary embodiments do not in any way limit the scope of the content defined by the claims laid out herein. Note also that all of the elements described in the present embodiment should not necessarily be taken as essential elements Preferred exemplary embodiments of the present disclosure will be described with reference to the drawings. The present disclosure is not limited by the embodiments described below, and embodiments to which the present disclosure is applicable are not limited to the following embodiments. In the drawings, identical elements are denoted with identical reference numerals.

First Embodiment

First, a first embodiment will be described. In the present embodiment, a switch machine is taken as an example of "railroad equipment that is driven by a motor from the stopped state to perform a prescribed operation and then comes into the stopped state again", and the "prescribed operation" is defined as switching operation by the switch machine.

[System Configuration]

FIG. 1 is an application example of a railroad equipment state determination apparatus 1 in the present embodiment. The railroad equipment state determination apparatus 1 is implemented as one apparatus in a railroad equipment monitoring system that performs centralized monitoring of railroad equipment or as one function of a central apparatus. The railroad equipment state determination apparatus 1 determines the state of each switch machine 10 as railroad equipment such as the presence or absence of a sign of abnormality, based on measurement data on the switch machine 10 that is acquired via a communication line.

The switch machine 10 is an electric switch machine that uses an electric motor 12 as a motive power source and has, as main components, the electric motor 12, a clutch 14, a switching gear group 16, and an operation rod 18 that is a moving part. The switch machine 10 performs a series of steps of switching operation including transferring rotation output of the electric motor 12 to the switching gear group 16 by the clutch 14, converting the rotation output into torque suitable for driving a switching mechanism by the switching gear group 16, switching and moving tongue rails by direct movement that is a displacement operation of the operation rod 18 by the switching mechanism to switch a turnout between normal position and reverse position, and bringing the tongue rails into close contact with stock rails.

As the measurement data on the switch machine 10, the voltage (motor voltage) and current (motor current) of the electric motor 12 and the stroke position of the operation rod 18 that is a displacement position are measured. The measurement data is obtained by sensors 20 attached to the switch machine 10, collected by a control terminal 50 (see FIG. 12) installed near the switch machine 10, and transmitted to the railroad equipment state determination apparatus 1 at an arbitrary timing. The sensors 20 (22, 24, 26) may be installed outside the switch machine 10 or may be built in the switch machine 10.

The motor voltage and the motor current are measured by the voltage/current sensor 22 that measures drive voltage and drive current of the electric motor 12. The stroke position may be measured by the sensor 26 that optically detects the movement amount of the operation rod 18 performing direct movement, or may be determined by converting a value detected by the optical or magnetic sensor 24 that detects the rotation amount of the gear included in the switching gear group 16 into a stroke value.

[Determination Principle]

The state determination is performed based on operation data associated with one cycle of switching operations performed by the switch machine 10. In the present embodiment, used as the operation data is drive transition information that indicates the drive information of the electric motor 12 at each timing, the each timing being at the stroke position of the operation rod during the switching operation. The drive transition information is generated from the measurement data relating to the switch machine 10.

A series of steps of switching operation by the switch machine 10 includes: a release step in a period during which, when the operation rod 18 is in a locked and stopped state, the rotation of the electric motor 12 is started to release a lock mechanism; a switching step in a period during which the switching mechanism drives the operation rod 18 to switch the tongue rails until contacting the stock rails and then adheres leading ends of the tongue rails to the stock rails; and a lock step in a period during which the lock mechanism is locked to bring the operation rod 18 into the stopped state so that the electric motor 12 stops operation.

In the present embodiment, the period from the start to end of the switching operation from which the operation data is taken corresponds to the switching step but may include the release step and the lock step. The length of the period for operation data associated with one cycle of switching operation, that is, the length of the period of the switching step is constant in the same switch machine 10. The start and end of the switching step can be determined from the stroke position. Specifically, the switching step is started at a point of time when the stroke position starts to be displaced, and the switching step is ended at a point of time when the displacement of the stroke position is completed. In addition, the switching direction (reverse position/normal position) can be determined from the displacement direction of the stroke position.

Figure 2:
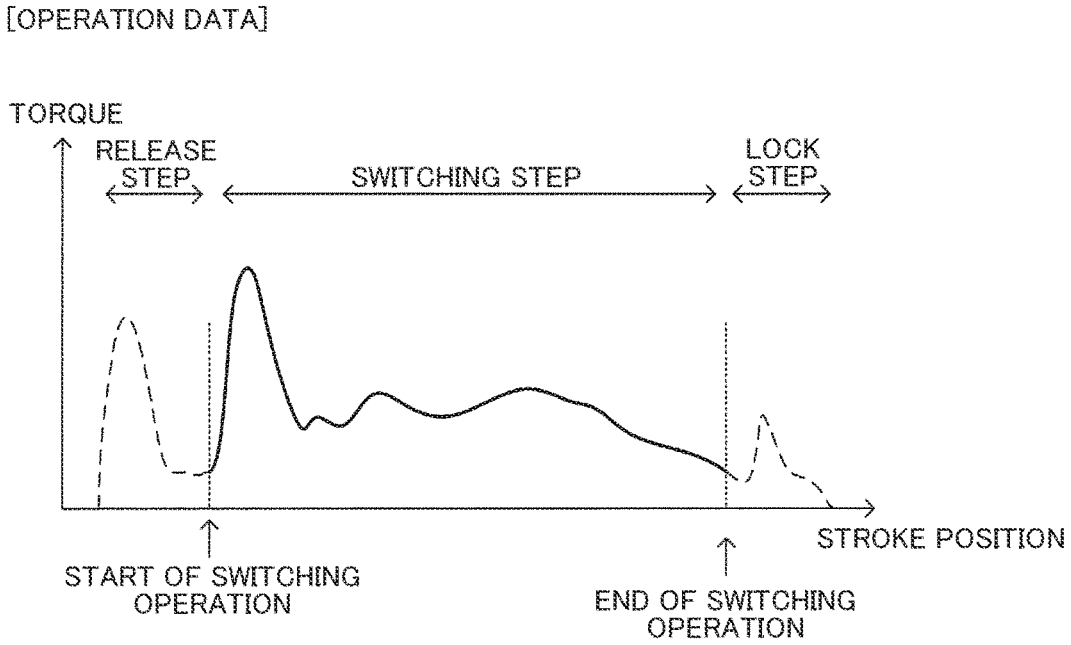
FIG. 2 is a diagram illustrating an example of operation data.

The drive transition information as the operation data is data that indicates transition of torque at each stroke position in a period from the start to end of the switching operation as in an example shown in FIG. 2. For example, the torque is determined from the motor voltage and the motor current at each stroke position, and data of the obtained torque at each stroke position is set as the drive transition information. The measurement data used for generation of the drive transition information (motor voltage, motor current, and stroke position) can be obtained by separate sensors 20 (22, 24, and 26) for corresponding measurement targets. However, all the measurement data can be obtained as measurement values at measurement times, and thus can be associated with one another with respect to the measurement times.

Figure 3:
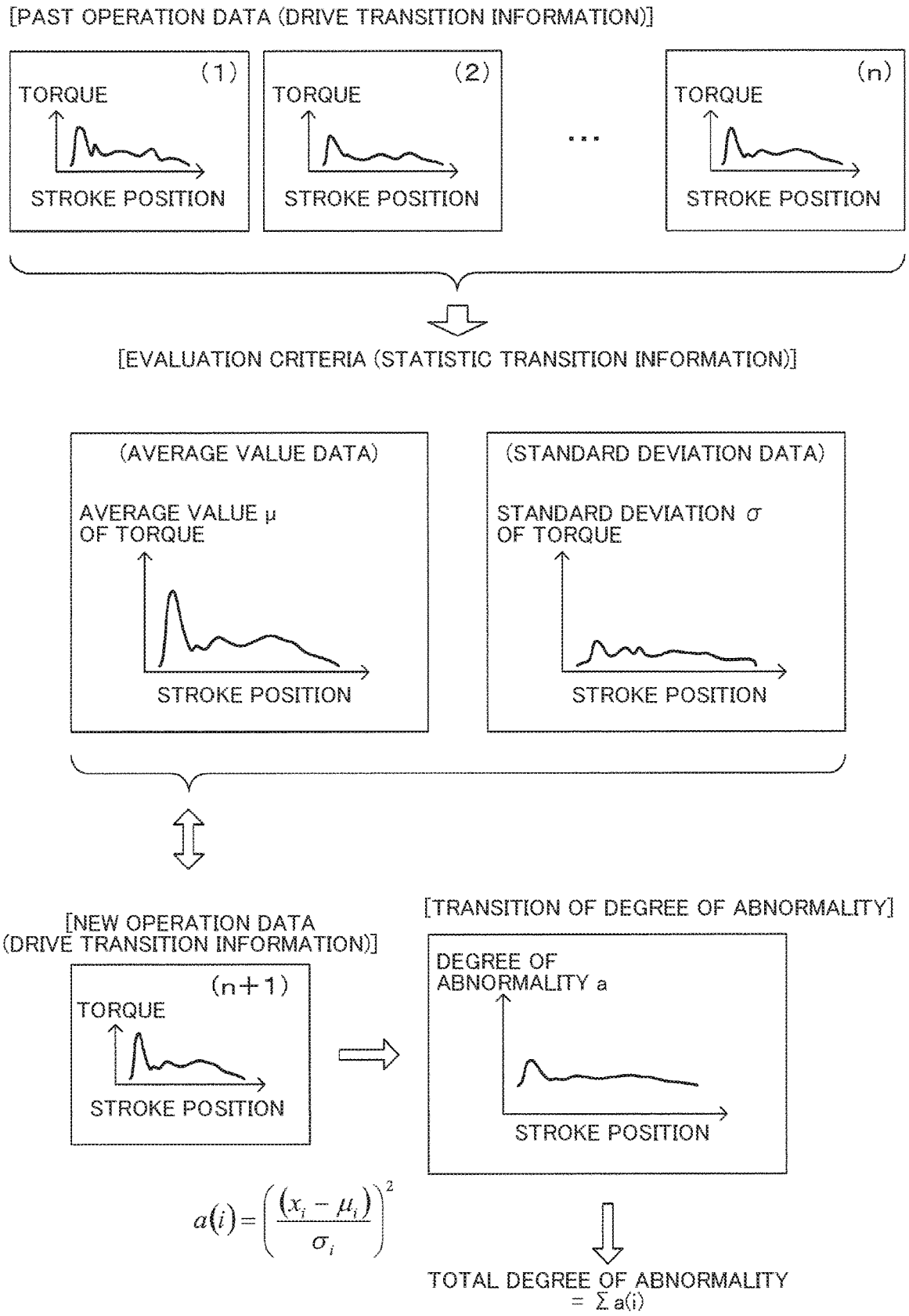
FIG. 3 is a diagram describing state determination of a switch machine according to a first embodiment.

FIG. 3 is a diagram describing the state determination of the switch machine 10. In relation to the state determination of the switch machine 10 in the present embodiment, the past operation data is stored and accumulated in advance in each switch machine 10. When a certain switch machine 10 performs a new switching operation and operation data (drive transition information) of the switching operation is generated as new operation data, statistic transition information and total abnormality threshold condition are set as evaluation criteria. Then, it is determined whether the new operation data is abnormal based on the evaluation criteria to determine the state of the target switch machine 10.

The statistic transition information indicates transition of statistics that are determined by statistically computing the drive information at each stroke position during the switching operation based on the drive transition information of the plurality of past operation data. For example, first, extracted from the past operation data of the switch machine 10 are operation data that indicate the same switching direction and were obtained at the operation dates within a predetermined number of nearest days from the operation date when the new operation data was obtained. Then, based on the drive transition information of the extracted operation data, average value data of average value μ of torque at each stroke position and standard deviation data of standard deviation σ of the torque at each stroke position are calculated and set as the statistic transition information. Specifically, at each stroke position in the period from the start to end of the switching operation (the period from the start to end of the switching step in the present embodiment), the average values μ of torque in the past operation data are determined to generate the average value data, and the standard deviations σ in the past operation data are determined to generate the standard deviation data.

The total abnormality threshold condition is a condition for determining that new operation data is abnormal, which can be set such as "a predetermined total abnormality determination threshold is exceeded".

In the state determination, first, the drive transition information of the new operation data and the average value data and standard deviation data of the statistic transition information are compared at each stroke position to calculate the transition of the degree of abnormality relating to the new operation data. That is, a degree of abnormality a(i) is determined at each stroke position i in the period from the start to end of the switching operation by the following equation (1):

$$a(i)=((xi-\mu i)/\sigma i)\hat{}2 \quad (1)$$

In the equation (1), "xi" denotes the torque of the stroke position i in the new operation data, "μi" denotes the average value of torque at the stroke position i in the average value data, and "σi" denotes the standard deviation of the stroke position i in the standard deviation data.

After that, based on the transition of the degree of abnormality, the total of the degrees of abnormality a(i) at the stroke positions i in the period from the start to end of the switching operation is calculated and set as total degree of abnormality. Then, it is determined whether the new operation data is abnormal based on whether the total degree of abnormality satisfies the total abnormality threshold condition.

Figure 4:
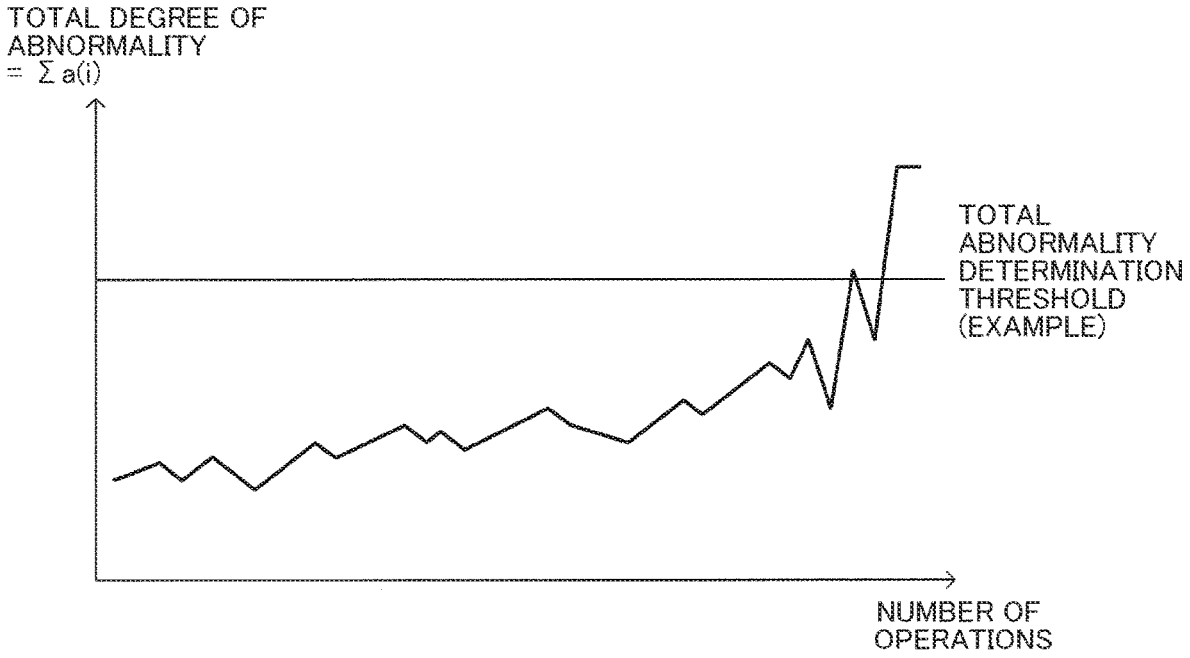
FIG. 4 is a diagram illustrating an example of transition of total degree of abnormality.

FIG. 4 is a graph of the total degree of abnormality to the number of operations, as an example of transition of the total degree of abnormality, which illustrates time-series transition of the total degree of abnormality. For example, if the total degree of abnormality determined for the new operation data exceeds the total abnormality determination threshold, it is determined that the total abnormality threshold condition is satisfied and the new operation data is abnormal.

In addition, the total degree of abnormality is compared with the total abnormality determination thresholds to determine the state of the target switch machine 10 such as the presence or absence of a sign of abnormality in the switch machine 10. That is, in the present embodiment, the total degree of abnormality is determined at each switching operation. To determine the total degree of abnormality, the statistic transition information is set from the past operation data including the operation data associated with the previous switching operation and is compared with the drive transition information of the new operation data associated with the current switching operation to calculate the current total degree of abnormality. In general, a switch machine is gradually worn out by repeating switching operation but the progress of wearing is very slow. Thus, from the long-term transition of the total degree of abnormality as illustrated in FIG. 4, the timing for maintenance work can be estimated and ascertained due to the tendency of the total degree of abnormality to increase gradually. Although not illustrated in FIG. 4, the transition of the total degree of abnormality before and after the maintenance work can be used as a guide for checking if the switch machine has returned to the normal state or has undergone sufficient maintenance work. From the transition of the total degree of abnormality, it is possible to predict the future transition of the total degree of abnormality for use in the execution of maintenance work or set appropriately the total abnormality determination thresholds (total abnormality threshold condition) for use in abnormality determination.

[Functional Configuration]

Figure 5:
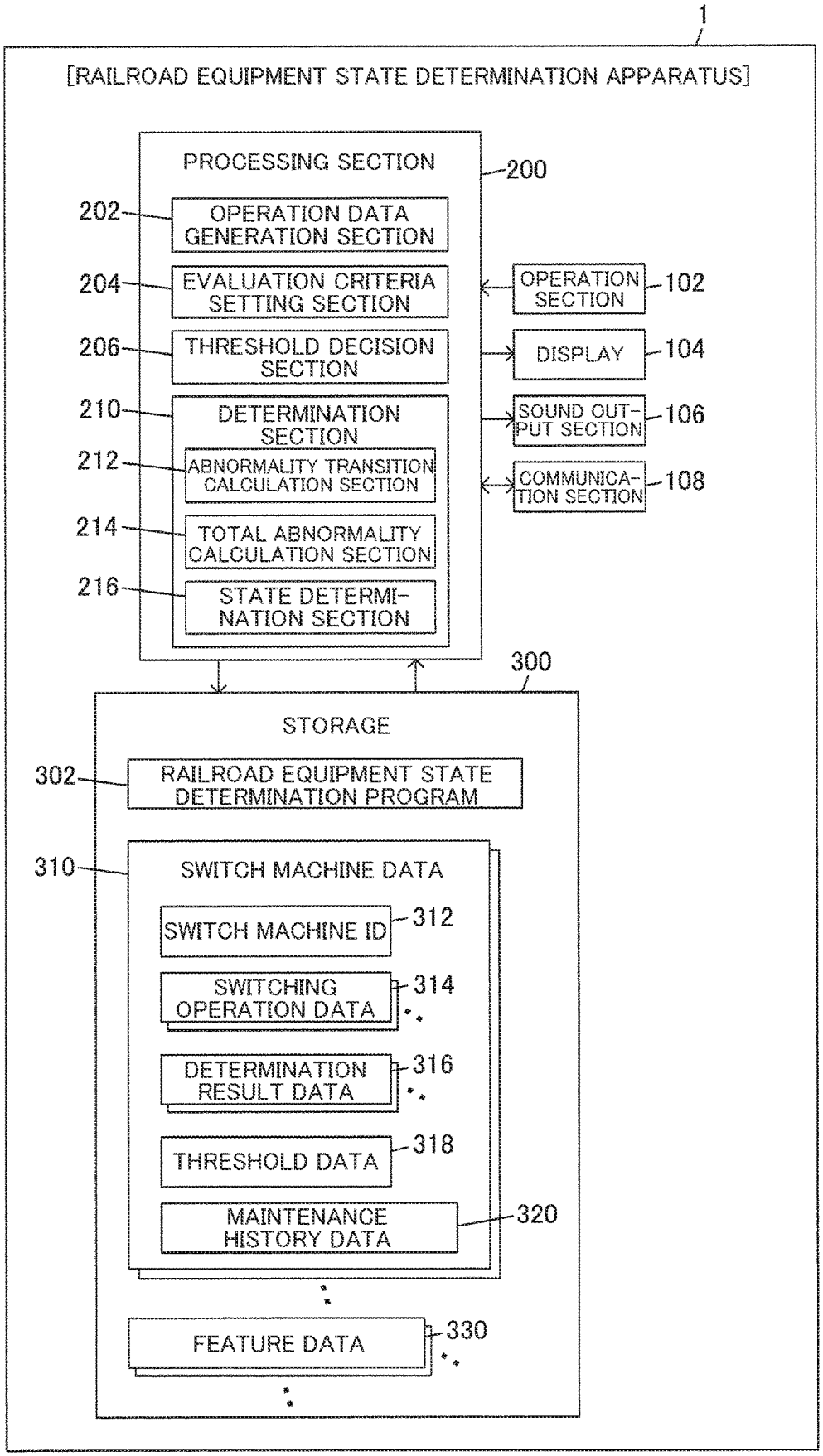
FIG. 5 is a functional configuration diagram of the railroad equipment state determination apparatus according to the first embodiment.

FIG. 5 is a functional configuration diagram of the railroad equipment state determination apparatus 1 according to the first embodiment. As illustrated in FIG. 5, the railroad equipment state determination apparatus 1 includes an operation section 102, a display 104, a sound output section 106, a communication section 108, a processing section 200, and a storage 300. The railroad equipment state determination apparatus 1 can constitute a sort of computer.

The operation section 102 is implemented by input devices such as button switches, a touch panel, and a keyboard, and outputs an operation signal corresponding to a received operation to the processing section 200. The display 104 is implemented by a display device such as a liquid crystal display (LCD) or a touch panel, and performs various types of displaying in accordance with a display signal from the processing section 200. The sound output section 106 is implemented by a sound output device such as a speaker, and performs various types of sound outputs in accordance with a sound signal from the processing section 200. The communication section 108 is implemented by a wired or wireless communication device that communicates with control terminals 50 (see FIG. 12) installed near the switch machines 10.

The processing section 200 is implemented by an arithmetic device such as a central processing unit (CPU), which provides instructions or transmits data to the individual components of the railroad equipment state determination apparatus 1 based on the programs and data stored in the storage 300 to control the entire railroad equipment state determination apparatus 1. The processing section 200 executes a railroad equipment state determination program 302 stored in the storage 300 to serve as the functional blocks including an operation data generation section 202, an evaluation criteria setting section 204, a threshold decision section 206, and a determination section 210. However, each of the functional blocks can be implemented as an independent arithmetic operation circuit, such as an application specific integrated circuit (ASIC) or a field programmable gate array (FPGA).

The operation data generation section 202 generates operation data associated with one cycle of switching operation by the switch machine 10 based on the measurement data relating to the switch machine 10. In the present embodiment, the drive transition information indicating the transition of torque at the stroke positions in the period from the start to end of the switching operation is generated and set as the operation data (see FIG. 2). Specifically, the motor voltage, the motor current, and the stroke positions that are the measurement data relating to the switch machine 10 can be all obtained as measurement values at the measurement times and thus can be associated with one another with reference to the measurement time. Accordingly, the torque is determined from the motor voltage and the motor current at each stroke position to generate the data of the torque to the stroke position. Next, the timings for starting and ending the switching operation (starting and ending the switching step in the present embodiment) are determined from the changes in the stroke position. Then, from the data of the torque at the stroke positions, the data in the period from the start to end of the switching operation is retrieved and set as the drive transition information, thereby obtaining the operation data associated with one cycle of switching operation. In addition, the switching direction of the switching operation is determined from the changes in the stroke position.

The evaluation criteria setting section 204 sets the statistic transition information and the total abnormality threshold condition as the evaluation criteria. Specifically, to set the statistic transition information to be the evaluation criterion for the new operation data regarding the switch machine 10, first, the operation data that were obtained at operation dates within a predetermined number of nearest days (for example, three days or ten days) is extracted from the past operation data of the switch machine 10 in the same switching direction. The operation data relating to the switching operation of the switch machine 10 can greatly vary between before and after maintenance work. Thus, only the operation data that were obtained at the execution date of the latest maintenance work and the subsequent dates may be extracted. The average value $\mu$ and standard deviation 6 of torque of the extracted operation data are determined at each stroke position in the period from the start to end of the switching operation, and the average value data and the standard deviation data are generated and set as the statistic transition information (see FIG. 3).

The evaluation criteria setting section 204 sets the total abnormality threshold condition according to the total abnormality determination thresholds separately decided by the threshold decision section 206. The threshold decision section 206 decides the total abnormality determination thresholds for setting the total abnormality threshold condition.

Specifically, the threshold decision section 206 determines the time-series transition of the total degree of abnormality that is the result of the past state determinations of the target switch machine 10, and decides the total abnormality determination thresholds based on the determined transition. Otherwise, the threshold decision section 206 classifies the past total degrees of abnormality by the situation of the switching operation corresponding to the operation data. For example, the threshold decision section 206 classifies the past total degrees of abnormality by a plurality of situations including a period such as month or season, a time zone such as daytime or nighttime, an operation environment such as temperature or humidity, and weather such as clear sky or rain. The threshold decision section 206 determines the time-series transition of the total degree of abnormality under each of the classifications, and decides the total abnormality determination thresholds under each of the classifications. In this case, the evaluation criteria setting section 204 sets the total abnormality threshold condition by using the total abnormality determination thresholds under the classification satisfying a predetermined proximity condition to the situation in which the switching operation corresponding to the new operation data was performed, and the determination section 210 performs the state determination under the total abnormality threshold condition set by the evaluation criteria setting section 204. The proximity condition is a condition under which it can be regarded that the situation is the same as or similar to that in which the switching operation was performed. Specifically, the condition can be set such that there is a match in all the plurality of situations including period, time zone, operation environment, and weather or there is a match in some of these situations. For example, the condition can be set such that the period is "January", the season and time zone are "daytime in summer", and the weather and temperature are "clear sky at a temperature of 20 degree or higher". The time-series transition of the total degree of abnormality (see FIG. 4) may be suggested to the user by displaying on the display 104 and the total abnormality determination thresholds may be set in accordance with the user's operation instruction using the operation section 102.

The determination section 210 includes an abnormality transition calculation section 212, a total abnormality calculation section 214, and a state determination section 216.

The abnormality transition calculation section 212 compares the drive transition information of the new operation data generated by the operation data generation section 202 with the statistic transition information set by the evaluation criteria setting section 204 at stroke positions in the period from the start to end of the switching operation, thereby to calculate the transition of the degree of abnormality relating to the new operation data. Specifically, the degrees of abnormality a(i) at the stroke positions i are calculated by the equation (1) to determine the transition of the degree of abnormality (see FIG. 3).

The total abnormality calculation section 214 synthesizes the transition of degree of abnormality calculated by the abnormality transition calculation section 212 to calculate the total degree of abnormality. That is, the total abnormality calculation section 214 calculates the total of the degrees of abnormality a(i) at the stroke positions i from the start to end of the switching operation to set the total degree of abnormality (see FIG. 3).

The state determination section 216 determines whether the new operation data is abnormal based on whether the total degree of abnormality calculated by the total abnormality calculation section 214 satisfies the total abnormality threshold condition set by the evaluation criteria setting section 204, thereby to determine the state of the switch machine 10. Specifically, when the total degree of abnormality exceeds the total abnormality determination threshold and satisfies the total abnormality threshold condition, the state determination section 216 determines that the new operation data is abnormal. In addition, the state determination section 216 compares the total degree of abnormality with the total abnormality determination thresholds to determine the presence or absence of a sign of abnormality in the state of the switch machine 10.

The storage 300 is implemented by a storage device such as a hard disk, a ROM, or a RAM. The storage 300 stores programs and data for the processing section 200 to integrally control the railroad equipment state determination apparatus 1. The storage 300 is used as a work area for the processing section 200 to temporarily store the result of arithmetic operations executed by the processing section 200 in accordance with the programs, data input via the operation section 102 or the communication section 108, and others. In the present embodiment, the storage 300 stores a railroad equipment state determination program 302, switch machine data 310, and feature data 330. Determination result data 316 in the switch machine data 310 contains the total degree of abnormality. Therefore, the storage 300 can be said to be a total abnormality storage.

The switch machine data 310 is generated for each switch machine 10 and contains switching operation data 314, the determination result data 316, threshold data 318, and maintenance history data 320 in association with a switch machine ID 312 for identifying the switch machine 10.

Figure 6:
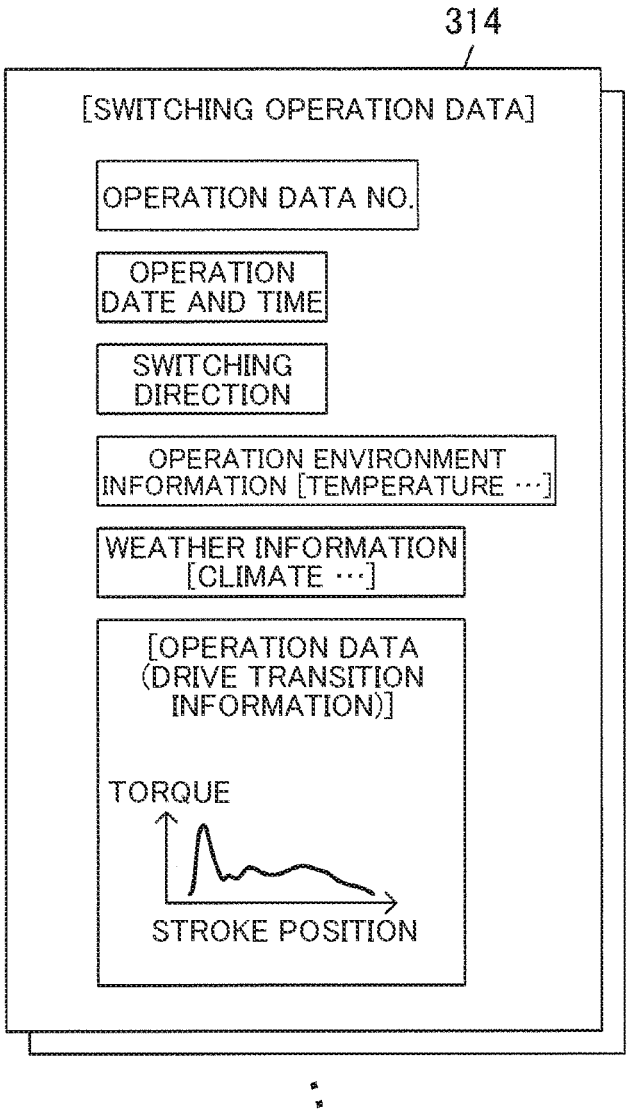
FIG. 6 is a diagram illustrating an example of switching operation data.

The switching operation data 314 is data relating to one cycle of switching operation performed by the switch machine 10, which contains the operation data generated by the operation data generation section 202 together with the accompanying information indicating the situation in which the switching operation was performed. Specifically, as illustrated in FIG. 6, the switching operation data 314 contains, in association with operation data No. for identifying the switching operation, operation date and time when the switching operation was performed (date and time), switching direction, operation environment information such as temperature and humidity, weather information such as clear sky or rain, and operation data associated with the switching operation (the drive transition information in the present embodiment).

Figure 7:
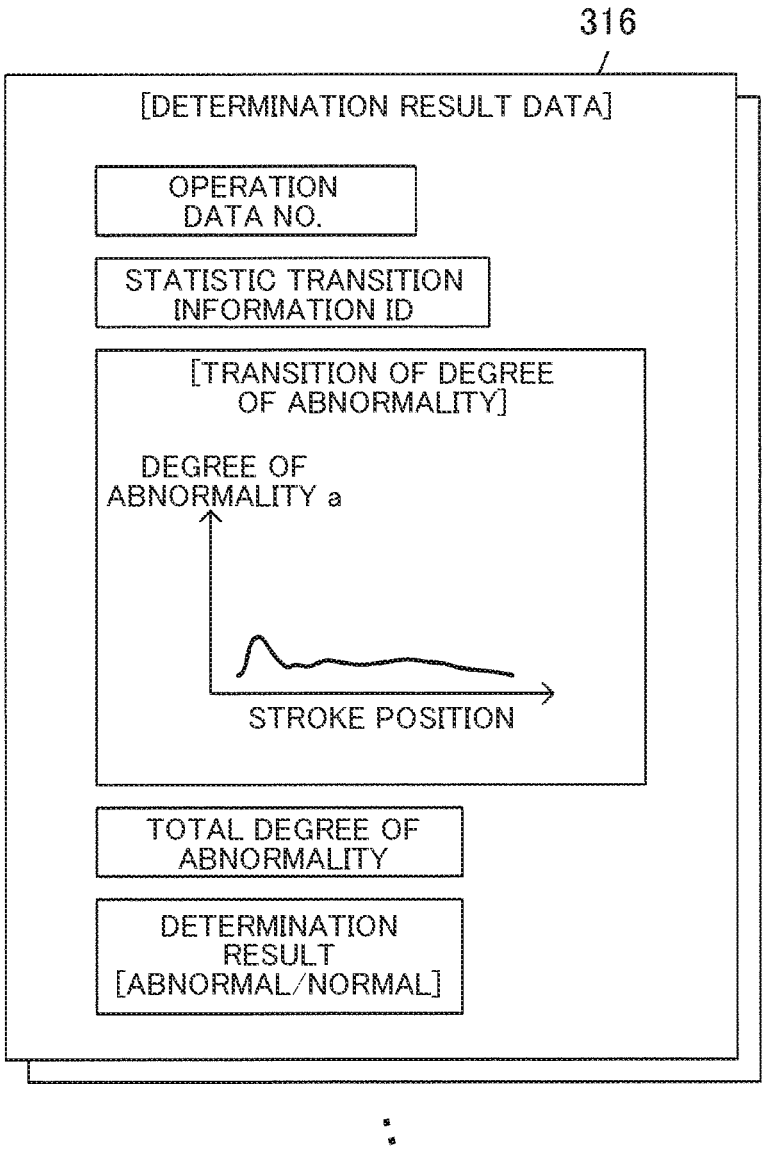
FIG. 7 is a diagram illustrating an example of determination result data.

The determination result data 316 is data relating to the result of the state determination on the operation data of the switch machine 10, which contains operation data No. of the corresponding operation data, statistic transition information ID of the statistic transition information used as the evaluation criterion, transition of the degree of abnormality, total degree of abnormality, and determination result as illustrated in FIG. 7.

The threshold data 318 includes data of the total abnormality determination thresholds decided by the threshold decision section 206, which contains the total abnormality determination thresholds for each switch machine 10.

The maintenance history data 320 is a history of maintenance work performed on the switch machine 10, which contains the execution date and time of maintenance work and the contents of the executed maintenance work in association with each other.

Figure 8:
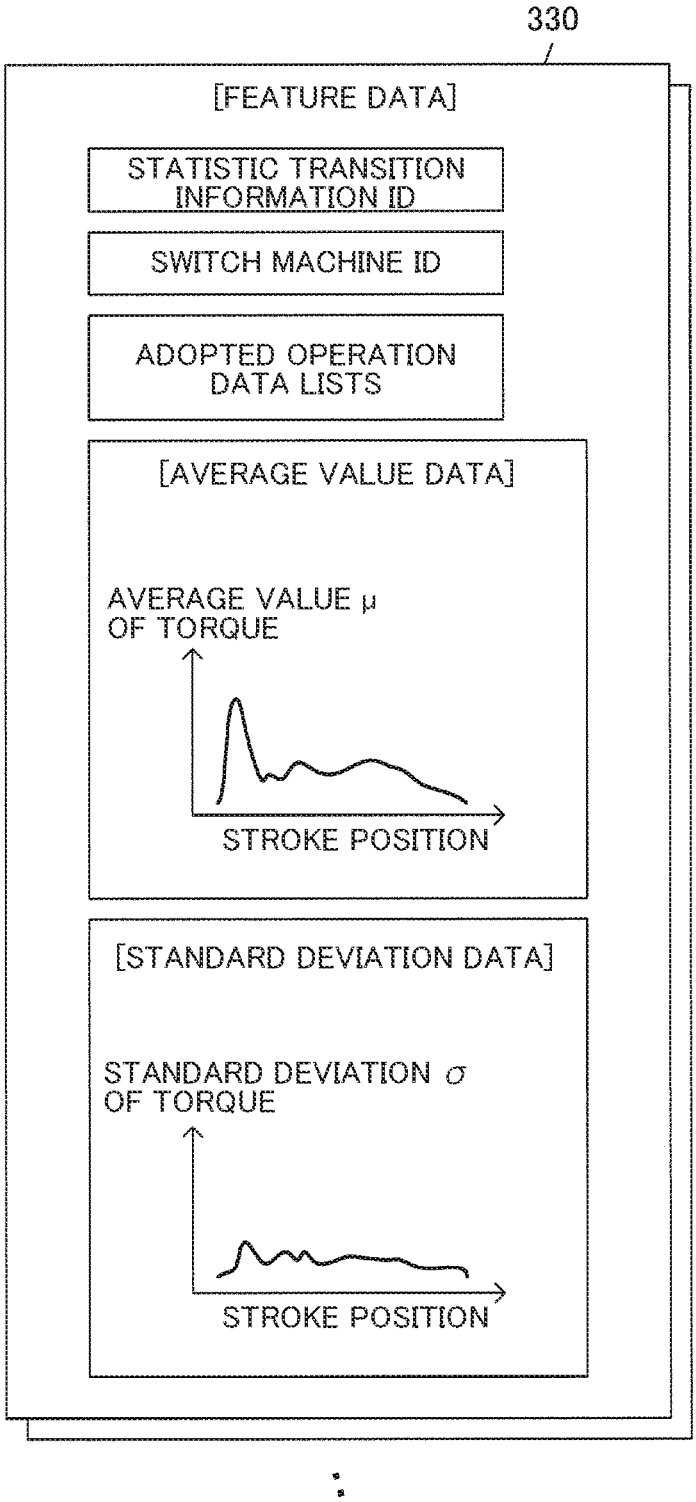
FIG. 8 is a diagram illustrating an example of feature data.

The feature data 330 is data relating to the statistic transition information set by the evaluation criteria setting section 204, which contains an adopted operation data list, and average value data and standard deviation data that are the statistic transition information, in association with statistic transition information ID for identifying the statistic transition information and the switch machine ID for identifying the target switch machine 10 as illustrated in FIG. 8. The adopted operation data list is a list of operation data No. of past operation data used for generation of the statistic transition information.

[Process Flow]

Figure 9:
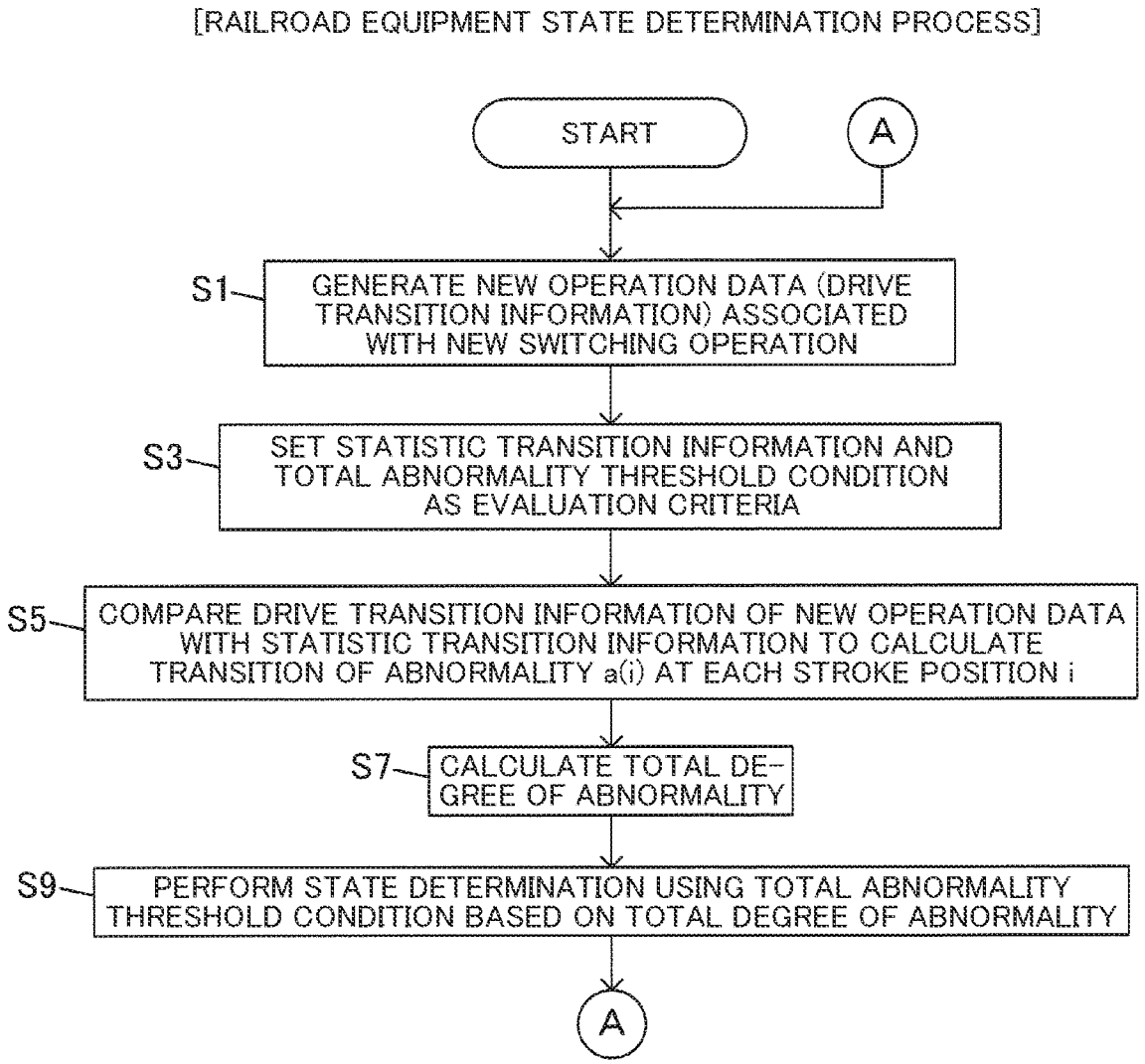
FIG. 9 is a flowchart of a railroad equipment state determination process according to the first embodiment.

FIG. 9 is a flowchart of a railroad equipment state determination process. The process described here is performed on the switch machines 10 in parallel by the processing section 200 reading the railroad equipment state determination program 302 from the storage 300 and executing the read program.

First, the operation data generation section 202 generates operation data associated with a new switching operation (new operation data) based on measurement data relating to the target switch machine 10 (step S1). In the present embodiment, the operation data generation section 202 generates data of torque at each stroke position in the period from the start to end of the switching operation as the drive transition information, and sets the data as operation data.

Next, the evaluation criteria setting section 204 sets the statistic transition information to be the evaluation criterion for the new operation data (drive transition information) and the total abnormality threshold condition to be the evaluation criterion for the total degree of abnormality (step S3). Specifically, the evaluation criteria setting section 204 generates the statistic transition information based on the past operation data of the target switch machine 10, and reads from the threshold data 318 the total abnormality determination thresholds for the target switch machine 10 separately decided by the threshold decision section 206 to set the total abnormality threshold condition.

Then, the abnormality transition calculation section 212 compares the drive transition information of the new operation data with the set statistic transition information, calculates the degrees of abnormality a(i) at the stroke positions i in the period from the start to end of the switching operation, and calculates the transition of the degree of abnormality relating to the new operation data (step S5).

The total abnormality calculation section 214 summarizes the degrees of abnormality a(i) at the stroke positions in the calculated transition of the degree of abnormality to calculate the total degree of abnormality (step S7). After that, the state determination section 216 determines the state of the target switch machine 10 using the total abnormality threshold condition based on the calculated total degree of abnormality (step S9). Specifically, the state determination section 216 determines whether the new operation data is abnormal based on whether the total degree of abnormality satisfies the total abnormality threshold condition, and compares the total degree of abnormality with the total abnormality determination thresholds of the total abnormality threshold condition to determine the presence or absence of a sign of abnormality in the state of the target switch machine 10. Upon completion of the foregoing steps, the process returns to step S1 to repeat the same processing.

[Operation and Advantageous Effects]

In accordance with the first embodiment, the drive transition information of new operation data associated with a new switching operation by the railroad equipment is compared to the statistic transition information based on the past operation data at each stroke position to calculate the transition of the degree of abnormality during the switching operation relating to the new operation data, and the transition of the degree of abnormality is synthesized to calculate the total degree of abnormality associated with the switching operation. This makes it is possible to determine entirely one cycle of switching operation of the switch machine 10 as railroad equipment by the total degree of abnormality that is one parameter. Therefore, it is possible to determine whether the operation of the switch machine 10 is abnormal based on the total degree of abnormality that is one parameter, whatever abnormality occurs such as an error that is minor but is found in one cycle of switching operation or an instantaneous increase of value. This realizes a new technique for setting the evaluation criteria for each piece of railroad equipment and determining whether there is any abnormality in the prescribed operation of the railroad equipment based on the evaluation criteria corresponding to the railroad equipment.

Second Embodiment

In some cases, the switch machine 10 may not be capable of measuring the stroke position of the operation rod 18 for a structural reason or a reason of space in installation position, for example. To handle such cases, in a second embodiment, operation data is set as drive transition information and operation time corresponding to switching operation.

First, the drive transition information indicates drive information of an electric motor 12 at each timing during a switching operation as in the first embodiment. In the present embodiment, however, each timing is set after a lapse of time from the start to end of displacement of an operation rod in the switching operation. In the same switch machine 10, the length of the periods in the release step prior to the switching step and the lock step subsequent to the switching step are constant in any switching operation. Thus, the start time of the switching step is determined from rotation start time of the electric motor 12 associated with one cycle of switching operation is determined, and the end time of the switching step is determined from rotation end time of the electric motor 12. Then, data of torque to the lapse of time from the determined start time to end time of the switching step is generated as the drive transition information. After that, the state determination in the first embodiment can be applied.

However, the length of the period in the switching step, that is, the time from the start to end of the switching operation can vary. In the second embodiment, therefore, the length of the period in the switching step (the time length from the start time to end time of the switching step) is included as the operation time of the switching operation in the operation data. Then, prior to the state determination of new operation data, a preliminary screening is performed to determine whether the new operation data is normal based on the operation time. When it is determined as the result of the preliminary screening that the new operation data is normal, the state determination described above is applied.

In the preliminary screening, it is determined whether the operation time of the new operation data is abnormal based on an operation time threshold condition. The operation time threshold condition is a condition for determining that the operation time is abnormal, which is preset as an evaluation criterion prior to the preliminary screening.

Figure 10:
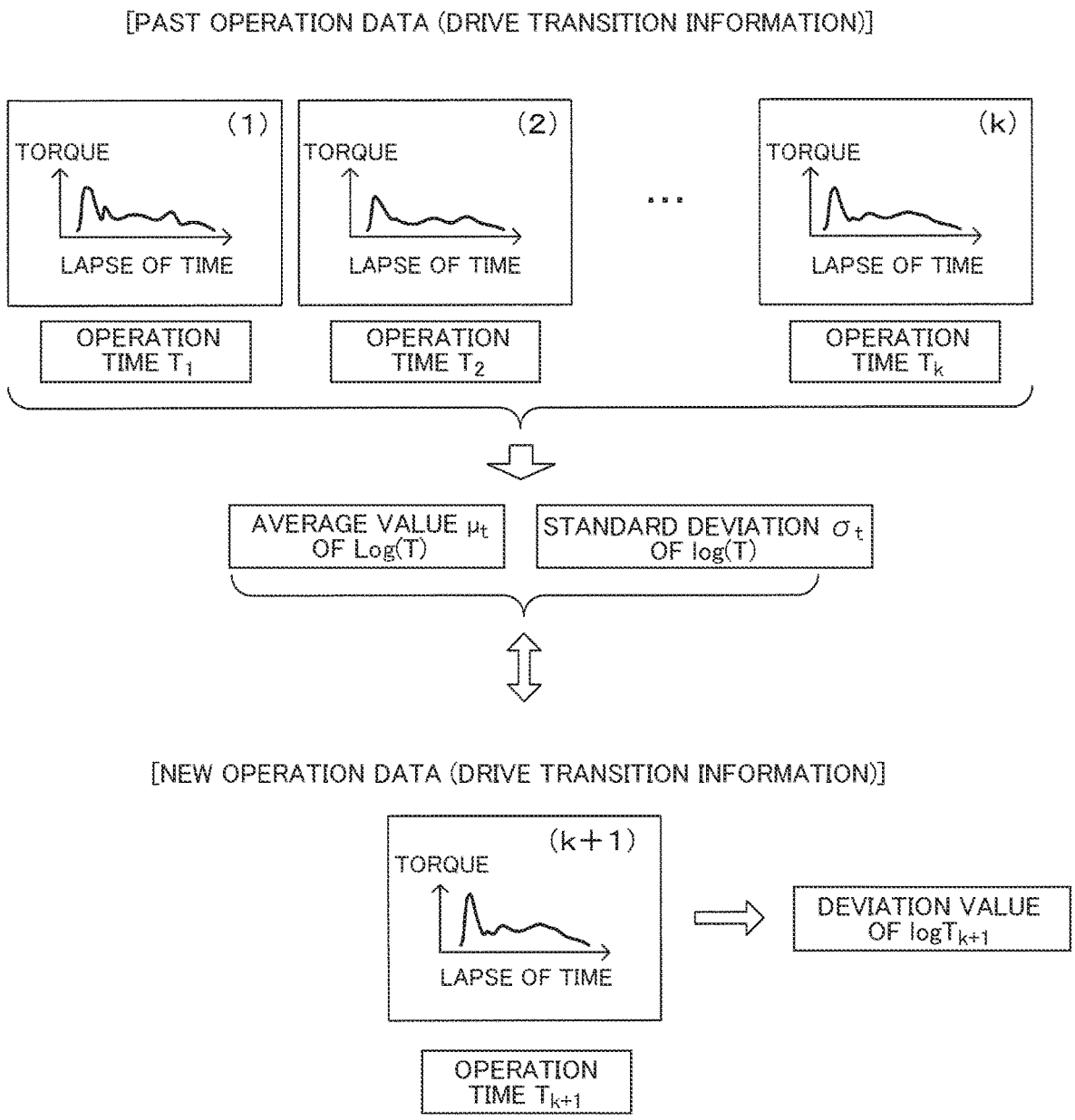
FIG. 10 is a diagram describing state determination of a switch machine according to a second embodiment.
Figure 11:
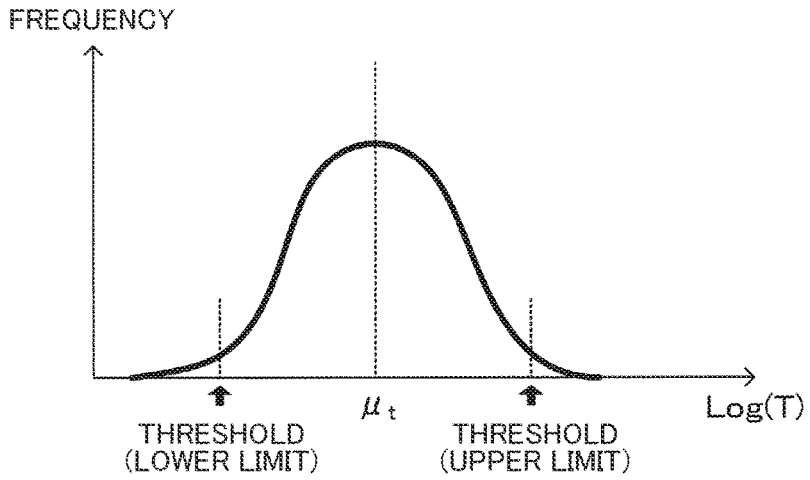
FIG. 11 is a diagram illustrating a setting example of operation time determination thresholds.

Specifically, as illustrated in FIG. 10, extracted from the past operation data that are associated with the switch machine 10 corresponding to the new operation data and indicate the same switching direction are a predetermined number of operation data within a predetermined number of nearest days of which operation times T were determined as normal in the preliminary screening of the corresponding operation data. Then, average values $\mu$ log(T) and standard deviations $\sigma$ log(T) of logarithm log(T) of the operation times T of the extracted operation data are determined. The average values $\mu$ log(T) and standard deviations $\sigma$ log(T) are used to determine a deviation value of log log(T) of the operation time T of the new operation data. The deviation value is compared to predetermined operation time determination thresholds to perform preliminary screening so that it is determined whether the operation time T of the new operation data is abnormal. The operation time determination thresholds can be determined as illustrated in FIG. 11. Specifically, the operation time determination thresholds are determined as upper limit and lower limit in a range centered on the average value $\mu$ log(T), and the operation time threshold condition is set as falling outside the range. When the deviation value of the new operation data falls outside the range, it is determined that the operation time threshold condition is satisfied and the new operation data is abnormal. When the deviation value of the new operation data falls within the range, it is determined that the operation time threshold condition is unsatisfied and the new operation data is normal.

Then, the time axis of the drive transition information of the operation data that was determined as normal in the preliminary screening is normalized such that the operation time becomes a predetermined normalized time, and then the state determination described above is applied. At that time, the degrees of abnormality a(i) at times i are calculated instead of the stroke positions because the drive transition information is data of torque to the lapse of time.

In the second embodiment, the operation data generation section 202 in the railroad equipment state determination apparatus 1 generates the data of torque to the lapse of time from the start time to end time of the switching step as the drive transition information, calculates the time length from the start time to the end time as the operation time of the switching operation, and sets them as operation data. The evaluation criteria setting section 204 sets statistic transition information, a total abnormality threshold condition, and an operation time threshold condition as evaluation criteria. Prior to the state determination, the determination section 210 performs preliminary screening to determine whether the operation time of the new operation data satisfies the operation time threshold condition.

Figure 12:
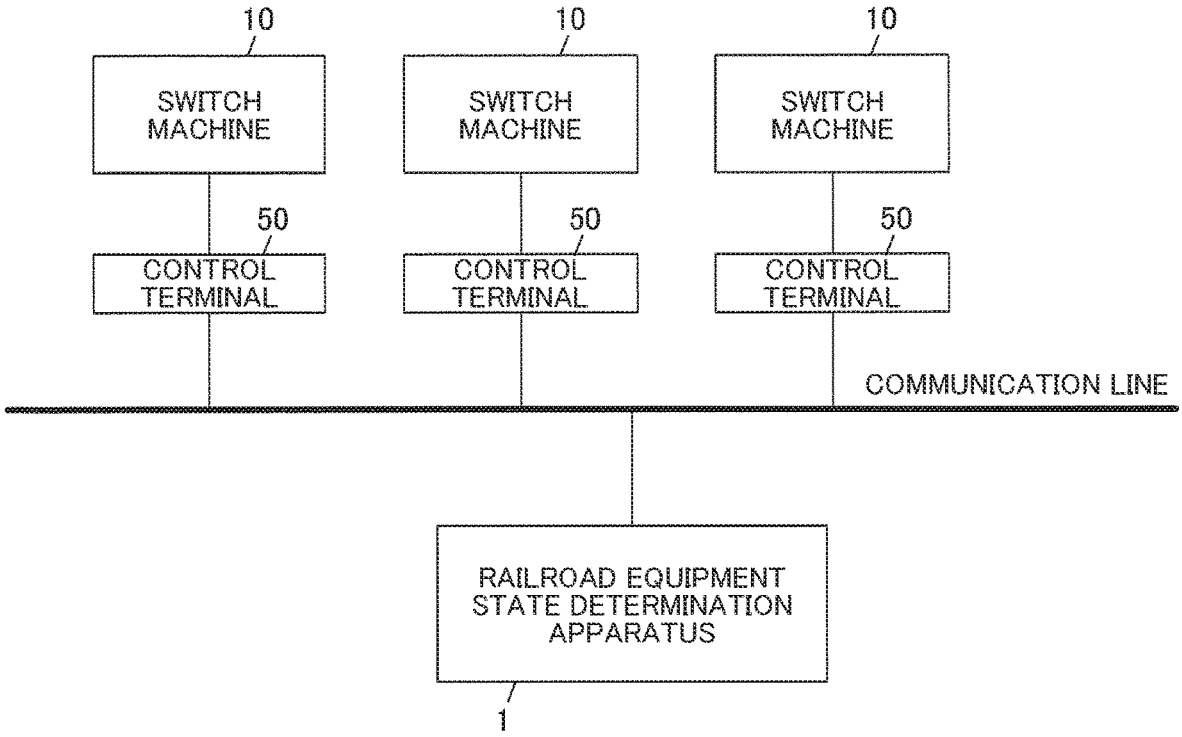
FIG. 12 is another diagram illustrating an application example of the railroad equipment state determination apparatus.

In relation to the first and second embodiments, it has been described that the drive transition information is generated by the railroad equipment state determination apparatus 1. Instead, the drive transition information may be generated by the control terminals 50. Specifically, although not illustrated in FIG. 1, the control terminals 50 are installed near the corresponding switch machines 10 to instruct the electric motors 12 to start and end rotation to control the switching operation as illustrated in FIG. 12. The control terminals 50 collect measurement data from sensors 20 (22, 24, and 26). Thus, the control terminals 50 can be configured to generate the drive transition information from the measurement data and transmit the same to the railroad equipment state determination apparatus 1. In that case, the control terminals 50 need to process the measurement data and generate the operation data at each switching operation but this reduces the processing load on the railroad equipment state determination apparatus 1. In addition, there is no need for the control terminals 50 to transmit the measurement data to the railroad equipment state determination apparatus 1, which decreases the amount of data to be transmitted.

Of the operation data generated by the railroad equipment state determination apparatus 1 in the second embodiment, the drive transition information may be generated by the railroad equipment state determination apparatus 1 and the operation time may be determined by the control terminals 50. For example, the control terminals 50 may be configured to calculate the length of the period of the switching step from the times when the control terminals 50 instructed the electric motors 12 to start and end rotation and from the lengths of the periods of the release step and the lock step, and transmit the determined length of the period as the operation time to the railroad equipment state determination apparatus 1.

In the first and second embodiments, the drive information of the motor as the operation data is torque. Alternatively, the motor current may be used instead.

Third Embodiment

Next, a third embodiment will be described. A railroad equipment state determination apparatus according to the third embodiment can be configured in the same manner as the railroad equipment state determination apparatus 1 illustrated in FIG. 5, but is different from the railroad equipment state determination apparatus 1 in some of the processes performed by the functional parts of the processing section. Hereinafter, the processes performed by the functional parts will be described focusing on the differences.

Figure 13:
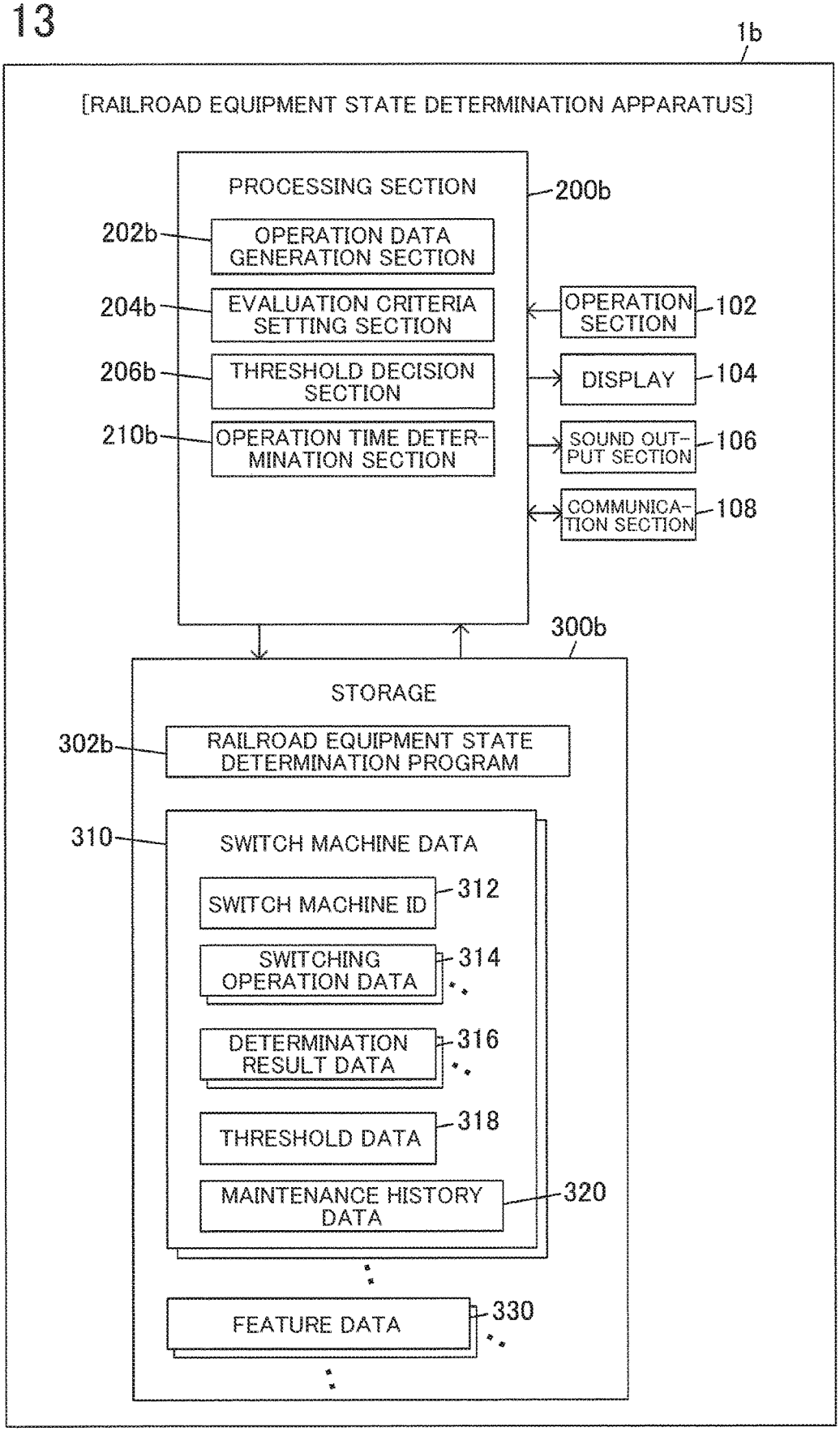
FIG. 13 is a functional configuration diagram of the railroad equipment state determination apparatus according to the third embodiment.

FIG. 13 is a functional configuration diagram of a railroad equipment state determination apparatus 1*b* according to the third embodiment. As illustrated in FIG. 13, the railroad equipment state determination apparatus 1*b* includes an operation section 102, a display 104, a sound output section 106, a communication section 108, a processing section 200*b*, and a storage 300*b*. The railroad equipment state determination apparatus 1*b* can constitute a sort of computer.

The processing section 200*b* executes a railroad equipment state determination program 302*b* stored in the storage 300*b* to serve as the functional blocks including an operation data generation section 202*b*, an evaluation criteria setting section 204*b*, a threshold decision section 206*b*, and an operation time determination section 210*b*.

In the third embodiment, operation data is set as operation time of a switching operation. Based on the operation time, the state determination of a switch machine 10 is performed. Thus, in the third embodiment, the operation data generation section 202*b* acquires the operation time determined by a control terminal 50 in the same manner as in the second embodiment, and sets the operation time as new operation data. The evaluation criteria setting section 204*b* sets an operation time threshold condition and an operation time abnormality threshold condition as evaluation criteria. The operation time determination section 210*b* calculates an operation time abnormality relating to the new operation data that has been determined as normal in preliminary screening, and determines whether the new operation data is abnormal depending on whether the operation time abnormality satisfies the operation time abnormality threshold condition.

The threshold decision section 206*b* decides an operation time abnormality determination threshold for determining the operation time abnormality threshold condition. The operation time abnormality determination threshold can be decided in the same manner as the total abnormality determination threshold in the first embodiment. For example, the time-series transition of the operation time abnormality as the results of the past state determinations of the target switch machine 10 is determined and the operation time abnormality determination threshold is decided based on the transition. Alternatively, the past operation time abnormalities associated with the target switch machine 10 may be classified by the situation in which the switching operation corresponding to the operation data was performed, and the time-series transition of the operation time abnormality may be determined in each classification, thereby to decide the operation time abnormality determination threshold in each classification. Otherwise, the operation time abnormality determination threshold may be determined in accordance with the user's operation instruction.

Figure 14:
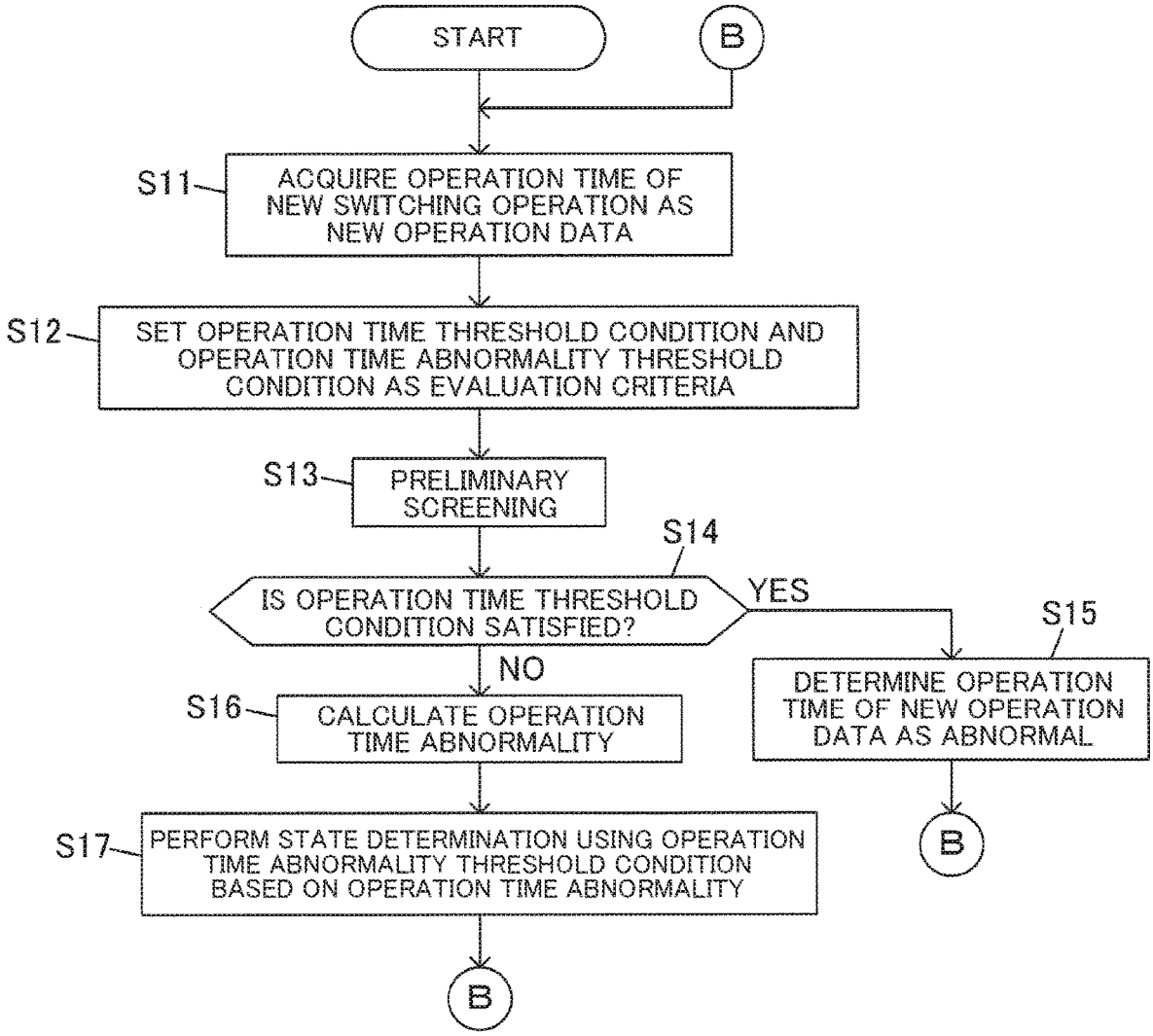
FIG. 14 is a flowchart of a railroad equipment state determination process according to the third embodiment.

FIG. 14 is a flowchart of a railroad equipment state determination process performed by the railroad equipment state determination apparatus 1*b* according to the third embodiment. First, the operation data generation section 202*b* acquires the operation time of a new switching operation from the control terminal 50 and sets the operation time as new operation data (step S11).

Then, the evaluation criteria setting section 204*b* sets the operation time threshold condition for performing the preliminary screening described above in relation to the second embodiment and the operation time abnormality threshold condition to be the evaluation criterion for the new operation data (operation time) (step S12). The operation time abnormality threshold condition is set based on the operation time abnormality determination threshold separately decided by the threshold decision section 206*b*.

After that, the operation time determination section 210*b* performs the preliminary screening to determine whether the acquired operation time of the new operation data satisfies the operation time threshold condition (step S13). When the operation time threshold condition is satisfied (step S14: YES), the operation time determination section 210*b* determines that the operation time of the new operation data is abnormal (step S15), and the process returns to step S11. On the other hand, when the operation time threshold condition is not satisfied (step S14: NO), the process moves to step S16.

In step S16, the operation time determination section 210*b* calculates the operation time abnormality based on the operation time of the new operation data and the distribution of the operation times included in a predetermined number of operation data before the performance of the switching operation associated with the new operation data. For example, the operation time determination section 210*b* obtains the operation time abnormality of the new operation data from a deviation value of log log(TN) of an operation time TN of the new operation data determined by the preliminary screening. Specifically, the operation time determination section 210*b* extracts a predetermined number of operation data from the past operation data, and determines an average value μ log(T) and a standard deviation σ log(T) in a log log(T) of the operation time T. Then, the operation time determination section 210*b* calculates an operation time abnormality a2 in accordance with the following equation (2):

$$a2=(\log(TN)-\mu\ \log(T))/\sigma\ \log(T) \tag{2}$$

The operation time determination section 210*b* may determine an operation time abnormality a3 in accordance with the equation (3) shown below. In the equation (3), "μT" denotes the average value of the operation times T in the extracted past operation data, and "σT" denotes the standard deviation of the operation times T in the operation data. The operation time determination section 210*b* may determine both the operation time abnormality a2 and the operation time abnormality a3 so that the subsequent state determination is performed based on the determined values. In that case, the operation time abnormality threshold condition including thresholds for both the abnormalities are set.

$$a3=(TN-\mu T)/\sigma T \tag{3}$$

Figure 15:
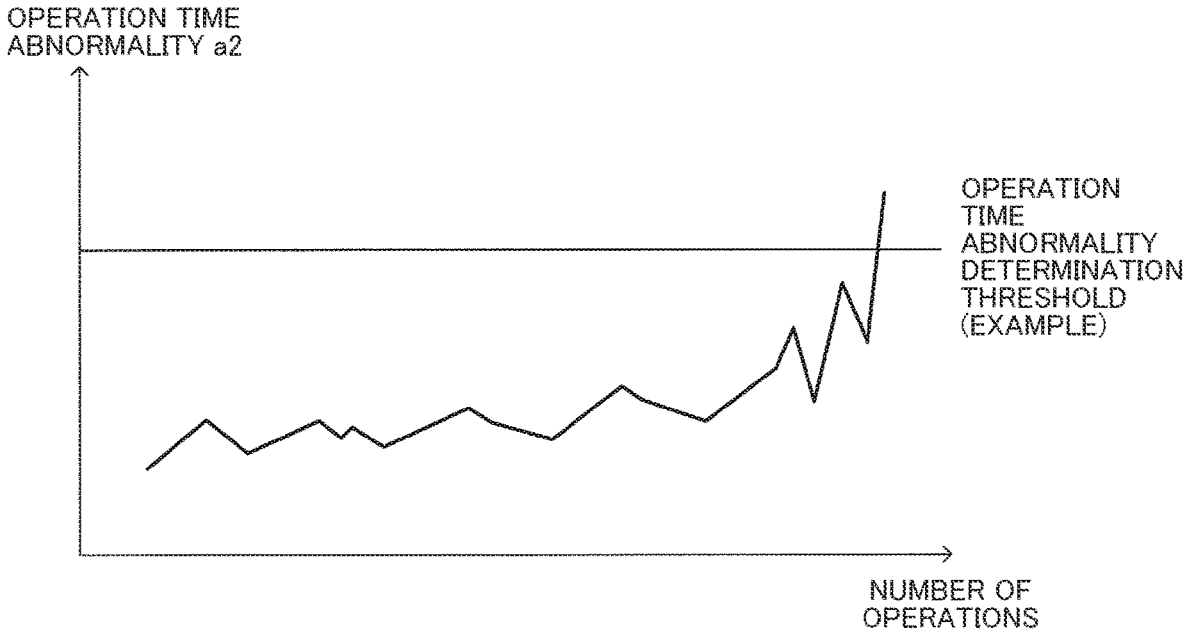
FIG. 15 is a diagram illustrating an example of transition of operation time abnormality.

The operation time determination section 210*b* determines the state of the target switch machine 10 using the operation time abnormality threshold condition based on the calculated operation time abnormality (step S17). Specifically, the operation time determination section 210*b* determines whether the new operation data is abnormal based on whether the operation time abnormality a2 (or the operation time abnormality a3) of the new operation data satisfies the operation time abnormality threshold condition. For example, as illustrated in FIG. 15, when the operation time abnormality a2 exceeds the operation time abnormality determination threshold, the operation time determination section 210*b* determines that the operation time abnormality threshold condition is satisfied and the new operation data is abnormal. The operation time determination section 210*b* also determines the state of the target switch machine 10 such as the presence or absence of a sign of abnormality from the transition of the operation time abnormality a2 illustrated in FIG. 15. For example, it is possible to estimate the timing for maintenance from the tendency of change in the operation time abnormality a2 or check if appropriate maintenance has been performed from the transition of the operation time abnormality a2 between before and after the maintenance. Upon completion of the foregoing steps, the process returns to step S11 to repeat the same processing.

The preliminary screening based on the operation time threshold condition (step S13 illustrated in FIG. 14) may not be performed. In that case, there is no need to set the operation time threshold condition in step S12.

In accordance with the third embodiment, it is possible to first determine whether the operation time of the new operation data is abnormal based on the operation time threshold condition, and then perform the preliminary screening of the new operation data in which the operation time is obviously abnormal. Then, when it is determined as the result of the preliminary screening that the operation time of the new operation data is normal, it is possible to calculate the operation time abnormality relating to the new operation data that is one parameter, based on the operation time of the new operation data and the distribution of the operation times of the past switching operations before the performance of the current switching operation. It is also possible to decide the operation time abnormality determination threshold using the operation time abnormalities relating to the past operation data. Comparing the operation time abnormality with the operation time abnormality determination threshold makes it possible to determine whether the new operation data is abnormal and perform the state determination of the switch machine 10 having performed the switching operation such as the presence or absence of a sign of abnormality. Therefore, it is easier to perform the state determination than in the first embodiment, thereby to reduce the processing load on the railroad equipment state determination apparatus 1*b*.

In accordance with the third embodiment, the railroad equipment state determination apparatus 1*b* collects and accumulates the operation times of the switching operations from the control terminals 50 as operation data. Therefore, the storage capacity of the railroad equipment state determination apparatus 1*b* for accumulating the operation data can be made smaller than that in the first embodiment. In addition, it is possible to significantly decrease the amount of data to be transmitted from the control terminals 50 to the railroad equipment state determination apparatus 1*b*, and thus the present embodiment is also applicable to the case with a limitation on the transmission capacity of the transmission path.

Fourth Embodiment

Next, a fourth embodiment will be described. A railroad equipment state determination apparatus according to the fourth embodiment can be configured in the same manner as the railroad equipment state determination apparatus 1 illustrated in FIG. 5, but is different from the railroad equipment state determination apparatus 1 in some of the processes performed by the functional parts of the processing section. Hereinafter, the processes performed by the functional parts will be described focusing on the differences.

In the fourth embodiment, operation data is set as data of quantity of electricity required for a switching operation. The state determination of a switch machine 10 is performed based on the data of quantity of electricity. Thus, in the fourth embodiment, at the performance of a new switching operation by the switch machine 10, control terminals 50 calculate the quantity of electricity required for the switching operation, and transmit the same to a railroad equipment state determination apparatus 1*c* (see FIG. 16). The quantity of electricity is determined by multiplying an average value of motor current (average current value) measured by a voltage/current sensor 22 in a period from the start to end of the switching operation by the time of the period (operation time). Alternatively, the quantity of electricity may be determined by multiplying a maximum value of motor current (maximum current value) measured in the period from the start to end of the switching operation by the operation time. Still alternatively, the quantity of electricity may be determined by integrating motor current values measured periodically at predetermined time intervals in the period from the start to end of the switching operation. Otherwise, the value obtained by multiplying an average or maximum value of motor voltage by the operation time may be used as energy data instead of the quantity of electricity.

The quantity of electricity may be calculated by an operation data generation section 202*c* (see FIG. 16) in the railroad equipment state determination apparatus 1*c*. In that case, the control terminals 50 transmit the motor current as the measurement data to the railroad equipment state determination apparatus 1*c* in the same manner as in the first embodiment.

Figure 16:
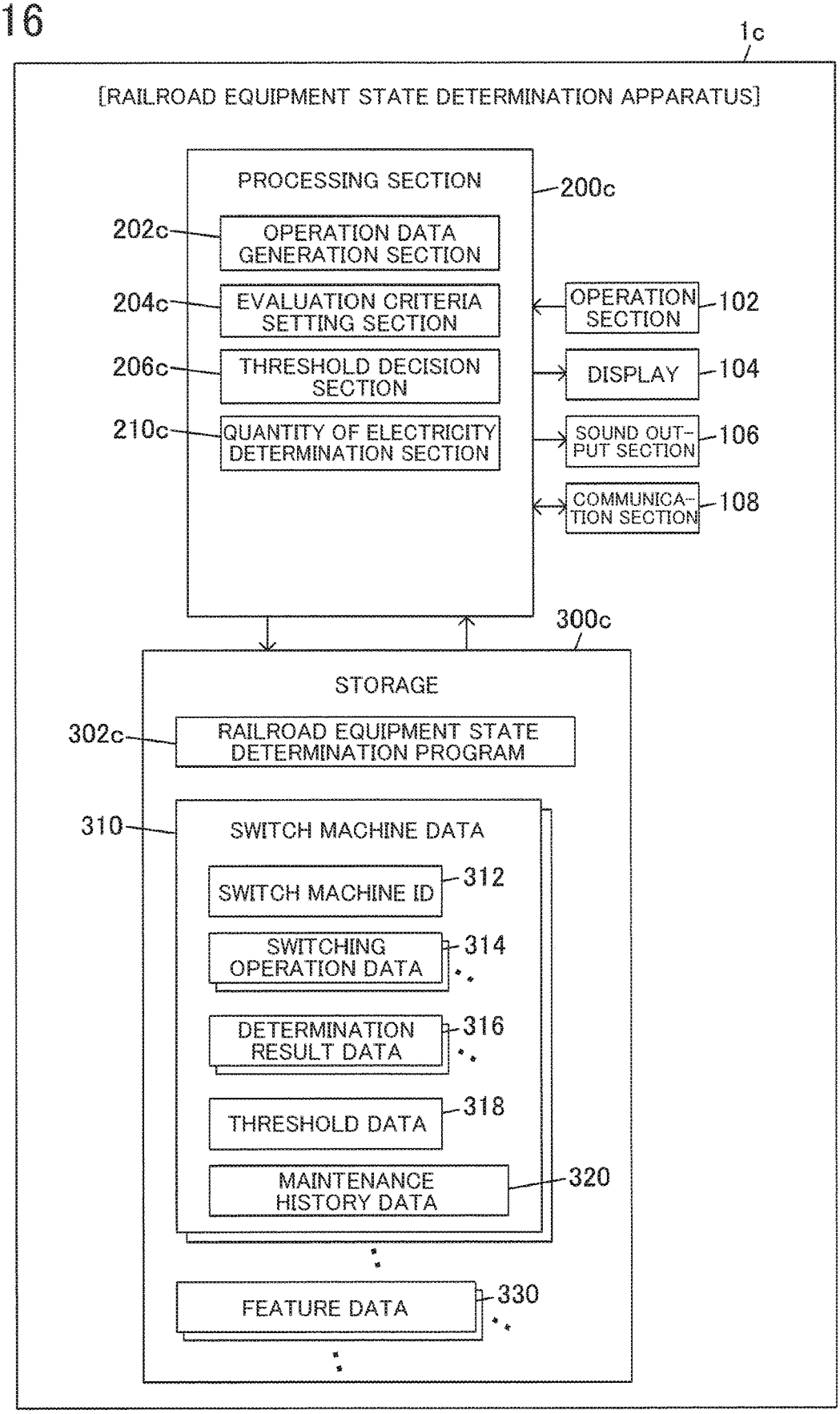
FIG. 16 is a functional configuration diagram of the railroad equipment state determination apparatus according to the fourth embodiment.

FIG. 16 is a functional configuration diagram of the railroad equipment state determination apparatus 1*c* according to the fourth embodiment. As illustrated in FIG. 16, the railroad equipment state determination apparatus 1*c* includes an operation section 102, a display 104, a sound output section 106, a communication section 108, a processing section 200*c*, and a storage 300*c*. The railroad equipment state determination apparatus 1*c* can constitute a sort of computer.

The processing section 200*c* executes a railroad equipment state determination program 302*c* stored in the storage 300*c* to serve as the functional blocks including an operation data generation section 202*c*, an evaluation criteria setting section 204*c*, a threshold decision section 206*c*, and an quantity of electricity determination section 210*c*.

The operation data generation section 202*c* acquires the quantity of electricity determined by the control terminals 50 and sets the same as new operation data. The evaluation criteria setting section 204*c* sets an quantity of electricity threshold condition and an quantity of electricity abnormality threshold condition as evaluation criteria. The quantity of electricity determination section 210*c* calculates quantity of electricity abnormality relating to the new operation data that has been determined as normal in the preliminary screening, and determines whether the new operation data is abnormal depending on whether the quantity of electricity abnormality satisfies the quantity of electricity abnormality threshold condition.

The threshold decision section 206*c* decides an quantity of electricity abnormality determination threshold for determining the quantity of electricity abnormality threshold condition. The quantity of electricity abnormality determination threshold can be decided in the same manner as the total abnormality determination threshold in the first embodiment. For example, the time-series transition of the quantity of electricity abnormality as the results of the past state determinations of the target switch machine 10 is determined and the quantity of electricity abnormality determination threshold is decided based on the transition. Alternatively, the past quantity of electricity abnormalities associated with the target switch machine 10 may be classified by the situation in which the switching operation corresponding to the operation data was performed, and the time-series transition of the quantity of electricity abnormality may be determined in each classification, thereby to decide the quantity of electricity abnormality determination threshold in each classification. Otherwise, the quantity of electricity abnormality determination threshold may be determined in accordance with the user's operation instruction.

Figure 17:
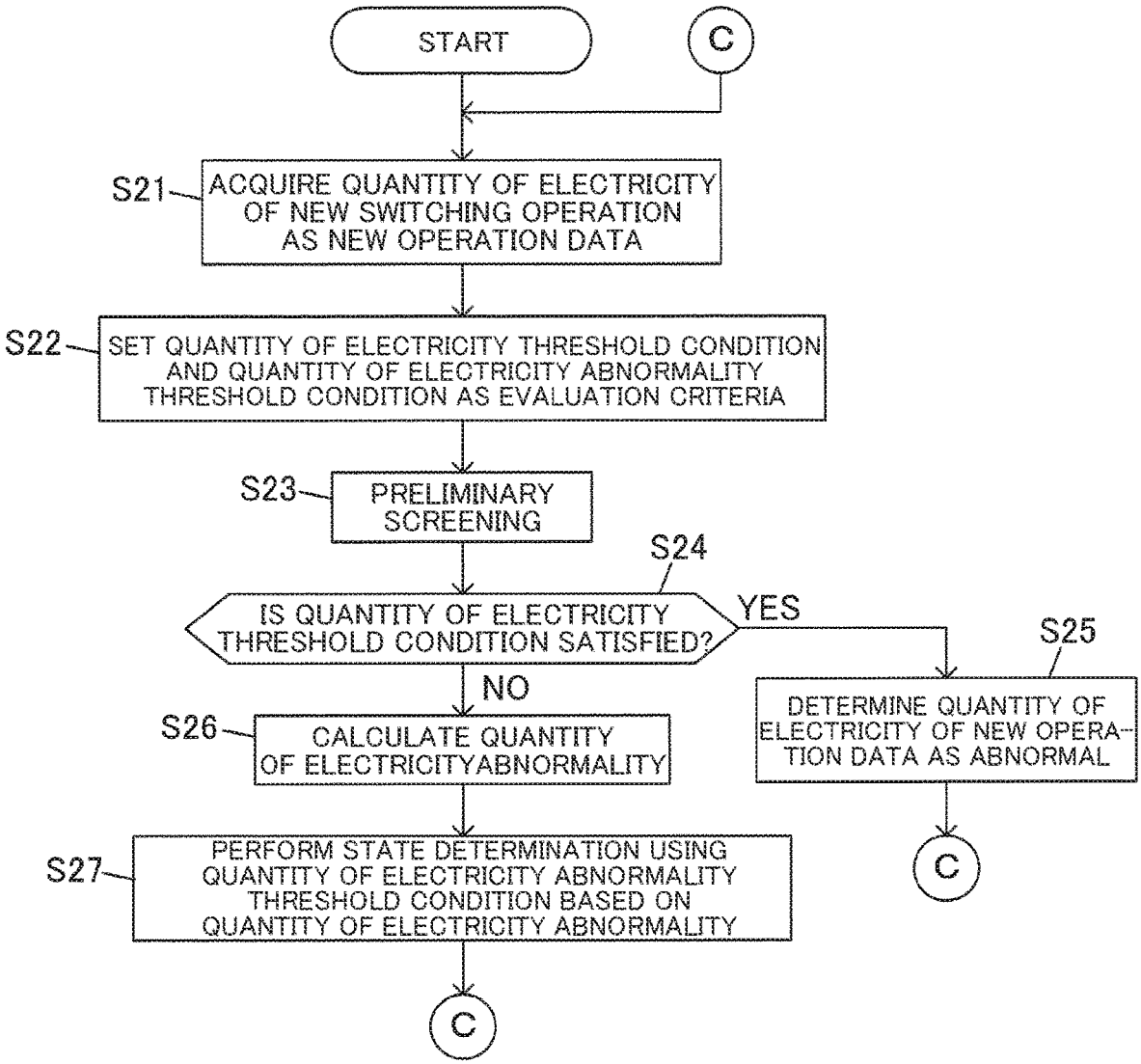
FIG. 17 is a flowchart of a railroad equipment state determination process according to the fourth embodiment.

FIG. 17 is a flowchart of a railroad equipment state determination process performed by the railroad equipment state determination apparatus 1*c* according to the fourth embodiment. First, the operation data generation section 202*c* acquires the quantity of electricity of a new switching operation from the control terminal 50 and sets the same as new operation data (step S21).

Then, the evaluation criteria setting section 204*c* sets the quantity of electricity threshold condition for performing preliminary screening and the quantity of electricity abnormality threshold condition to be an evaluation criterion for the new operation data (quantity of electricity) (step S22). The quantity of electricity abnormality threshold condition is set based on the quantity of electricity abnormality determination threshold separately decided by the threshold decision section 206*c*.

After that, the quantity of electricity determination section 210*c* performs the preliminary screening to determine whether the acquired quantity of electricity of the new operation data satisfies the quantity of electricity threshold condition (step S23). For example, first, extracted from the past operation data of the same switch machine 10 that indicate the same switching direction are a predetermined number of operation data within a predetermined number of nearest days of which quantity of electricity E were determined as normal in the preliminary screening of the corresponding operation data. Then, average values μ log(E) and standard deviations σ log(E) of logarithm log(E) of the quantity of electricity E in the extracted operation data are determined. The average values μ log(E) and standard deviations σ log(E) are used to determine the deviation value of log log(E) of the quantity of electricity E of the new operation data. The deviation value is compared to predetermined quantity of electricity determination thresholds to perform preliminary screening so that it is determined whether the quantity of electricity E of the new operation data is abnormal. The quantity of electricity determination thresholds can be determined in the same manner as the operation time determination thresholds described above with reference to FIG. 11. Specifically, the quantity of electricity determination thresholds are determined as upper limit and lower limit in a range centered on the average value μ log(E), and the quantity of electricity threshold condition is set as falling outside the range.

When the deviation value of the new operation data falls outside the range, the quantity of electricity determination section 210*c* determines that the quantity of electricity threshold condition is satisfied (step S24: YES), then determines that the quantity of electricity of the new operation data is abnormal (step S25), and then the process returns to step S21.

On the other hand, when the deviation value falls within the range and does not satisfy the quantity of electricity threshold condition (step S24: NO), the process moves to step S26.

In step S26, the quantity of electricity determination section 210*c* calculates the quantity of electricity abnormality based on the quantity of electricity of the new operation data and the distribution of the quantity of electricity contained in the predetermined number of operation data before performance of the switching operation associated with the new operation data. For example, the quantity of electricity determination section 210*c* obtains the quantity of electricity abnormality of the new operation data from the deviation value of log log(EN) of the quantity of electricity EN in the new operation data determined by the preliminary screening. That is, the quantity of electricity determination section 210*c* calculates an quantity of electricity abnormality a4 according to the following equation (4):

$$a4=(\log(EN)-\mu\log(E))/\sigma\log(E) \tag{4}$$

The quantity of electricity determination section 210*c* may determine an quantity of electricity abnormality a5 in accordance with the equation (5) shown below. In the equation (5), "μE" denotes the average value of quantity of electricity E in the extracted past operation data, and "σE" denotes the standard deviation of the quantity of electricity E in the operation data. The quantity of electricity determination section 210*c* may determine both the quantity of electricity abnormality a4 and the quantity of electricity abnormality a5 so that the subsequent state determination is performed based on the determined values. In that case, the quantity of electricity abnormality threshold condition including thresholds for both the abnormalities are set.

$$a5=(EN-\mu E)/\sigma E \tag{5}$$

The quantity of electricity determination section 210*c* determines the state of the target switch machine 10 using the quantity of electricity abnormality threshold condition based on the calculated quantity of electricity abnormality (step S27). Specifically, the quantity of electricity determination section 210*c* determines whether the new operation data is abnormal based on whether the quantity of electricity abnormality a4 (or the quantity of electricity abnormality a5) of the new operation data satisfies the quantity of electricity abnormality threshold condition. For example, when the quantity of electricity abnormality a4 exceeds the quantity of electricity abnormality determination threshold, the quantity of electricity determination section 210*c* determines that the quantity of electricity abnormality threshold condition is satisfied and the new operation data is abnormal. The quantity of electricity determination section 210*c* also determines the state of the target switch machine 10 such as the presence or absence of a sign of abnormality from the transition of the quantity of electricity abnormality a4. For example, it is possible to estimate the timing for maintenance from the tendency of increase in the quantity of electricity abnormality a4 or check if appropriate maintenance has been performed from the transition of the quantity of electricity abnormality a4 between before and after the maintenance. Upon completion of the foregoing steps, the process returns to step S21 to repeat the same processing.

The preliminary screening based on the quantity of electricity threshold condition (step S23 illustrated in FIG. 17) may not be performed. In that case, there is no need to set the quantity of electricity threshold condition in step S22.

In accordance with the fourth embodiment, it is possible to first determine whether the quantity of electricity of the new operation data is abnormal based on the quantity of electricity threshold condition, and then perform the preliminary screening of the new operation data in which the quantity of electricity is obviously abnormal. Then, when it is determined as the result of the preliminary screening that the quantity of electricity of the new operation data is normal, it is possible to calculate the quantity of electricity abnormality relating to the new operation data that is one parameter, based on the quantity of electricity of the new operation data and the distribution of the quantity of electricity of the past switching operations before the performance of the current switching operation. It is also possible to decide the quantity of electricity abnormality determination threshold using the quantity of electricity abnormalities relating to the past operation data. Comparing the quantity of electricity abnormality with the quantity of electricity abnormality determination threshold makes it possible to determine whether the new operation data is abnormal and perform the state determination of the switch machine 10 having performed the switching operation such as the presence or absence of a sign of abnormality. Therefore, it is easier to perform the state determination than in the first embodiment, thereby to reduce the processing load on the railroad equipment state determination apparatus 1*c*.

In accordance with the fourth embodiment, the railroad equipment state determination apparatus 1*c* collects and accumulates the quantity of electricity of the switching operations from the control terminals 50 as operation data. Therefore, the storage capacity of the railroad equipment state determination apparatus 1*c* for accumulating the operation data can be made smaller than that in the first embodiment. In addition, it is possible to significantly decrease the amount of data to be transmitted from the control terminals 50 to the railroad equipment state determination apparatus 1*c*, and thus the present embodiment is also applicable to the case with a limitation on the transmission capacity of the transmission path.

In relation to each of the above-mentioned embodiments, the railroad equipment has been described as switch machine. However, the embodiments are similarly applicable to other railroad equipment in which the moving part operates with the motor as a motive power source, such as railroad crossing gate and platform door, for example. In the case of a railroad crossing gate, the moving part corresponds to the crossing rod moving up and down, and in the case of a platform door, the moving part corresponds to the opening and closing door part.

Although only some embodiments of the present invention have been described in detail above, those skilled in the art will readily appreciate that many modifications are possible in the embodiments without materially departing from the novel teachings and advantages of this invention. Accordingly, all such modifications are intended to be included within scope of this invention.

What is claimed is:

1. A railroad equipment state determination apparatus, comprising:

a storage that stores a plurality of operation data associated with one cycle of a prescribed operation performed by railroad equipment, wherein the one cycle of the prescribed operation is that the railroad equipment driven by a motor from a stopped state performs a switching operation, and then comes into the stopped state again;

an evaluation criteria setting section that sets evaluation criteria based on the plurality of operation data stored in the storage; and a determination section that determines whether new operation data resulting from one cycle of the prescribed operation newly performed by the railroad equipment is abnormal based on the evaluation criteria, wherein the operation data includes data of drive transition information indicating drive information of the motor at each timing during the prescribed operation, the evaluation criteria setting section sets statistic transition information that indicates transition of statistics determined by statistically computing the drive information at each timing during the prescribed operation as one of the evaluation criteria, based on the drive transition information included in the operation data, and the determination section performs:

calculating transition of a degree of abnormality relating to the new operation data by comparing the drive transition information included in the new operation data with the statistic transition information at each timing during the prescribed operation;

calculating a total degree of abnormality by synthesizing the transition of the degree of abnormality; and determining whether the new operation data is abnormal based on the total degree of abnormality.

2. The railroad equipment state determination apparatus as defined in claim 1, further comprising a total abnormality storage that stores the total degrees of abnormality calculated in the past, wherein the evaluation criteria setting section sets a total abnormality threshold condition for determining that the new operation data is abnormal as one of the evaluation criteria, based on the total degrees of abnormality stored in the total abnormality storage, and the determination section determines whether the new operation data is abnormal based on whether the total degree of abnormality of the new operation data satisfies the total abnormality threshold condition.

3. The railroad equipment state determination apparatus as defined in claim 1, wherein the prescribed operation includes a displacement operation of displacing a moving part by the railroad equipment, and the drive transition information is information that indicates transition of the drive information with a displacement position of the moving part at each timing during the prescribed operation.

4. The railroad equipment state determination apparatus as defined in claim 1, wherein the prescribed operation includes a displacement operation of displacing a moving part by the railroad equipment, and the drive transition information is information that indicates transition of the drive information with a lapse of time from start to end of displacement of the moving part at each timing.

5. The railroad equipment state determination apparatus as defined in claim 1, wherein the drive information is information of torque or current.

6. A railroad equipment state determination apparatus, comprising:

a storage that stores a plurality of operation data associated with one cycle of a prescribed operation performed by railroad equipment, wherein the one cycle of the prescribed operation is that the railroad equipment driven by a motor from a stopped state performs a switching operation, and then comes into the stopped state again;

an evaluation criteria setting section that sets evaluation criteria based on the plurality of operation data stored in the storage; and a determination section that determines whether new operation data resulting from one cycle of the prescribed operation newly performed by the railroad equipment is abnormal based on the evaluation criteria, wherein the storage stores the operation data in association with operation dates, and the evaluation criteria setting section sets the evaluation criteria based on the operation data for a predetermined number of days nearest the operation date of the new operation data.

7. The railroad equipment state determination apparatus as defined in claim 6, wherein the railroad equipment is any of switch machine, railroad crossing gate, and platform door.

8. A railroad equipment state determination apparatus, comprising:

a storage that stores a plurality of operation data associated with one cycle of a prescribed operation performed by railroad equipment, wherein the one cycle of the prescribed operation is that the railroad equipment driven by a motor from a stopped state performs a switching operation, and then comes into the stopped state again;

an evaluation criteria setting section that sets evaluation criteria based on the plurality of operation data stored in the storage; and a determination section that determines whether new operation data resulting from one cycle of the prescribed operation newly performed by the railroad equipment is abnormal based on the evaluation criteria, wherein the operation data includes data of operation time of the prescribed operation, the evaluation criteria setting section sets an operation time threshold condition for determining that the operation time is abnormal as one of the evaluation criteria, based on distribution of the operation times included in the operation data, and the determination section determines whether the operation time included in the new operation data is abnormal based on the operation time threshold condition.

9. A railroad equipment state determination apparatus, comprising:

a storage that stores a plurality of operation data associated with one cycle of a prescribed operation performed by railroad equipment, wherein the one cycle of the prescribed operation is that the railroad equipment driven by a motor from a stopped state performs a switching operation, and then comes into the stopped state again;

an evaluation criteria setting section that sets evaluation criteria based on the plurality of operation data stored in the storage; and a determination section that determines whether new operation data resulting from one cycle of the prescribed operation newly performed by the railroad equipment is abnormal based on the evaluation criteria, wherein the operation data includes data of operation time of the prescribed operation, the determination section performs:

calculating an operation time abnormality relating to the new operation data, based on the operation time included in the new operation data and the distribution of the operation times included in a predetermined number of the operation data before the prescribed operation associated with the new operation data; and determining whether the new operation data is abnormal based on whether the operation time abnormality satisfies a given operation time abnormality threshold condition, and the evaluation criteria setting section sets the operation time abnormality threshold condition as one of the evaluation criteria, based on the operation time abnormalities calculated in the past.

10. A railroad equipment state determination apparatus, comprising:

a storage that stores a plurality of operation data associated with one cycle of a prescribed operation performed by railroad equipment, wherein the one cycle of the prescribed operation is that the railroad equipment driven by a motor from a stopped state performs a switching operation, and then comes into the stopped state again;

an evaluation criteria setting section that sets evaluation criteria based on the plurality of operation data stored in the storage; and a determination section that determines whether new operation data resulting from one cycle of the prescribed operation newly performed by the railroad equipment is abnormal based on the evaluation criteria, wherein the operation data includes data of a quantity of electricity required for the prescribed operation, the evaluation criteria setting section sets a quantity of electricity threshold condition for determining that the quantity of electricity is abnormal as one of the evaluation criteria, based on distribution of quantity of electricity included in the operation data, and the determination section determines whether the quantity of electricity included in the new operation data is abnormal based on the quantity of electricity threshold condition.

11. A railroad equipment state determination apparatus, comprising:

a storage that stores a plurality of operation data associated with one cycle of a prescribed operation performed by railroad equipment, wherein the one cycle of the prescribed operation is that the railroad equipment driven by a motor from a stopped state performs a switching operation, and then comes into the stopped state again;

an evaluation criteria setting section that sets evaluation criteria based on the plurality of operation data stored in the storage; and a determination section that determines whether new operation data resulting from one cycle of the prescribed operation newly performed by the railroad equipment is abnormal based on the evaluation criteria, wherein the operation data includes data of a quantity of electricity required for the prescribed operation, the determination section performs:

calculating a quantity of electricity abnormality relating to the new operation data, based on the quantity of electricity included in the new operation data and distribution of the quantity of electricity included in a predetermined number of the operation data before the prescribed operation associated with the new operation data; and determining whether the new operation data is abnormal based on whether the quantity of electricity abnormality satisfies a given quantity of electricity abnormality threshold condition, and the evaluation criteria setting section sets the quantity of electricity abnormality threshold condition as one of the evaluation criteria, based on the quantity of electricity abnormalities calculated in the past.

12. A railroad equipment state determination method comprising:

an evaluation criteria setting step of setting evaluation criteria based on a plurality of operation data associated with one cycle of a prescribed operation performed by railroad equipment, wherein the one cycle of the prescribed operation that the railroad equipment is-driven by a motor from a stopped state performs a switching operation, and then comes into the stopped state again;

a determination step of determining whether new operation data resulting from one cycle of the prescribed operation newly performed by the railroad equipment is abnormal based on the evaluation criteria, wherein the operation data is stored in a storage in association with operation dates, and the evaluation criteria is set based on the operation data for a predetermined number of days nearest the operation date of the new operation data.

* * * * *